US006652193B2

(12) United States Patent
Matsuura et al.

(10) Patent No.: US 6,652,193 B2
(45) Date of Patent: Nov. 25, 2003

(54) SWAYING REDUCTION APPARATUS AND FLOATING BODY THEREWITH

(75) Inventors: Masami Matsuura, Nagasaki (JP); Makoto Nishigaki, Nagasaki (JP); Takahiro Hirai, Nagasaki (JP); Youichi Yamaguchi, Nagasaki (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/854,472

(22) Filed: May 15, 2001

(65) Prior Publication Data

US 2003/0147702 A1 Aug. 7, 2003

(30) Foreign Application Priority Data

May 16, 2000 (JP) ..... 2000-142929
Apr. 6, 2001 (JP) ..... 2001-108277

(51) Int. Cl.[7] ..... B63B 39/06
(52) U.S. Cl. ..... 405/195.1; 114/122; 114/126
(58) Field of Search ..... 405/195.1, 211, 405/212; 114/122, 126, 264

(56) References Cited

U.S. PATENT DOCUMENTS

| | | | | |
|---|---|---|---|---|
| 2,752,874 A | | 7/1956 | Held | 114/126 |
| 2,972,322 A | | 2/1961 | Parker et al. | 114/271 |
| 2,984,200 A | | 5/1961 | Toussel | 114/121 |
| 3,224,401 A | | 12/1965 | Kobus | 114/265 |
| 3,842,777 A | * | 10/1974 | Larsh | 114/126 |
| 3,921,408 A | | 11/1975 | Lamy | 405/31 |
| 3,952,680 A | | 4/1976 | Griffin | 114/123 |
| 3,969,901 A | | 7/1976 | Matsudaira et al. | 405/23 |
| 4,004,536 A | * | 1/1977 | Bernier | 114/126 |
| 4,182,255 A | | 1/1980 | Reid | 114/146 |
| 4,232,623 A | * | 11/1980 | Chou et al. | 114/122 |
| 4,556,005 A | | 12/1985 | Jackson | 114/146 |
| 5,010,835 A | * | 4/1991 | Kunitake et al. | 114/126 |
| 5,242,243 A | | 9/1993 | Bachelier | 405/26 |
| 5,429,452 A | | 7/1995 | Frost | 405/26 |
| 5,819,678 A | | 10/1998 | Austin | 114/146 |
| 6,102,625 A | * | 8/2000 | Olsen et al. | 114/122 |

FOREIGN PATENT DOCUMENTS

| | | |
|---|---|---|
| DE | 174 728 | 6/1905 |
| DE | 25 28 477 | 1/1977 |
| DE | 29 09 169 | 9/1980 |
| DE | 40 25 002 | 9/1991 |
| FR | 1417153 | 10/1965 |
| GB | 2 310 407 | 8/1997 |
| JP | 58-81888 | 5/1983 |
| JP | 8-324485 | 12/1996 |
| JP | 2000-142569 | 5/2000 |
| JP | 2001-206284 | 7/2001 |

* cited by examiner

*Primary Examiner*—Thomas B. Will
*Assistant Examiner*—Tara L. Mayo
(74) *Attorney, Agent, or Firm*—Oblon, Spivak, McClelland, Maier & Neustadt, P.C.

(57) ABSTRACT

The motion reducing apparatus has an orthorhombic shaped floating main body, a horizontal plumb plate supported horizontally on one side section of the floating main body by stay members, and flow sections for flooding with incoming water are provided between the floating main body and the horizontal plate in such a way that the horizontal plate is at about the same height as the bottom surface of the floating main body.

5 Claims, 28 Drawing Sheets

FIG. 26

| | Fin1 | | | |
|---|---|---|---|---|
| | Fin1A | Fin1B | Fin1C | Fin1D |
| OVERALL LENGTH | 96.0m | | | |
| FIN WIDTH (SPACE INCLUDED) | 8.0m | | | |
| FIN WIDTH (SPACE NOT INCLUDED) | 8.0m | 7.5m | 7.0m | 6.1m |
| SPACING | 0.0m | 0.5m | 1.0m | 1.9m |

SWAYING REDUCTION APPARATUS AND FLOATING BODY THEREWITH

BACKGROUND OF THE INVENTION

1. Field of the Invention

The present invention relates to a motion reduction apparatus for reducing motions caused by incoming waves impacting on a structural body floating on water such as floating bridges, warehouses, parking lots, platform work ships, oil drilling platforms and a floating body having the motion reduction apparatus.

2. Description of the Related Art

When installing a floating bridge or floating parking lot, or working on a stationary platform ship, waves hitting such a floating bridge, parking lot or platform ship can sometimes cause the structural bodies to oscillate, so that it is necessary to reduce the severity of motion that such floating bodies may encounter.

Various apparatuses for reducing motion of a floating body have been proposed. For example, the present inventors have already proposed a method in a Japanese Patent Applications, First Publication, No. 2000-142569 and Japanese Patent Application, No. 2000-12790 (not published). The apparatus proposed in the Japanese Patent Application, First Publication, No. 2000-142569 has a plumb plate extending through the water surface on the wavefront side on the floating main body to reduce motion of the floating body. Also, in a wave-resistant large-scale floating body described in the Japanese Patent Application, No. 2000-12790, L- or inverted L-shaped break-wave structures of different shapes are provided on the wavefront side of the large-scale floating body to reduce motion of the floating body.

However, although such motion reduction apparatuses described above are able to reduce motion to some extent by adopting the prescribed structures, it is insufficient for many purposes. Therefore, there has been a demand for a motion reduction apparatus to further improve the safety of operation by reducing motion even more reliably.

The present invention is provided to resolve the problem described above, and an object is to provide a motion reduction apparatus that reliably reduces motion of a floating object to improve the safety of operation.

SUMMARY OF THE INVENTION

To achieve the object of the present invention, in a first aspect of the invention, a motion reduction apparatus for a floating body floating on water comprises a plumb plate provided at least on a wavefront side of a floating main body and separated from the floating main body by a specific distance and extended beyond a bottom surface of the floating main body substantially in a vertical direction.

According to the motion reduction apparatus, incoming waves impact the floating main body and the plumb plate and some of the incoming waves also flood through the flow sections, so that the wave energy that can act on the floating main body is reduced and the plumb plate reduces rolling or pitching of the floating main body, thus reliably reducing motion of the floating body to provide improved safety of operation of the floating body.

In a second aspect of the invention, the plumb plate is supported at a specific location of the floating main body by means of a plurality of stay members arranged on the floating main body in parallel so as to provide flow sections between the stay members for flooding with incoming water.

According to the motion reduction apparatus, the plumb plate can be supported at a desired location using a simple structure.

In a third aspect of the invention, the floating main body is orthorhombic-shaped, and the plumb plate is provided at least on one side section along the longitudinal direction of the floating main body.

According to the motion reduction apparatus, plumb plate can reliably suppress rolling motion of the floating main body.

In a fourth aspect of the invention, the plumb plate is constructed so as to be retractable above a bottom surface of the floating main body.

According to the motion reduction apparatus, when the floating main body is adopted to a platform work ship, for example, interference with cruising operation of the ship can be avoided by raising the plumb plate above the floating main body when not in use.

In a fifth aspect of the invention, the motion reduction apparatus for a floating body floating on water comprises a horizontal plate provided at least on a wavefront side of a floating main body and separated from the floating main body by a specific distance and extended substantially along a horizontal direction.

According to the motion reduction apparatus, incoming waves impact the side section of the floating main body while some of the incoming waves flood through the flow sections, so that the wave energy that can act on the floating main body is reduced and the resistance offered by the horizontal plate and the flow sections can suppress rolling or pitching motion of the floating main body, thus reliably reducing motion of the floating body to improve the safety of operation of the floating body.

In a sixth aspect of the motion reduction apparatus, an upper surface of the horizontal plate is situated at substantially at the same height as the bottom surface of the floating main body.

According to the motion reduction apparatus, resistance offered by the horizontal plate reliably reduces rolling.

In a seventh aspect of the invention, the horizontal plate is supported at a specific location of the floating main body by means of a plurality of stay members arranged on the floating main body in parallel so as to provide flow sections between the stay members for flooding with incoming water.

According to the motion reduction apparatus, the horizontal plate can be supported at a specific location using a simple structure.

In an eighth aspect of the invention, the floating main body is orthorhombic-shaped, and the horizontal plate is provided at least on one left side section or a right side section along the longitudinal direction of the floating main body.

According to the motion reduction apparatus, rolling motion of the floating main body can be reliably suppressed using the horizontal plate.

In a ninth aspect of the invention, the horizontal plate is constructed so as to be retractable above a bottom surface of the floating main body.

According to the motion reduction apparatus, when the floating main body is adopted to a platform work ship, for example, interference with cruising operation of the ship can be avoided by raising the horizontal plate above the floating main body when not in use.

In a tenth aspect of the invention, the motion reduction apparatus for a floating body floating on water comprises a swing plate provided at least on a wavefront side of a floating main body and separated from the floating main body by a specific distance so as to enable to position the swing plate in a retracted position situated above a bottom surface of the floating main body, or in a horizontal position situated substantially at the same height as the bottom surface of the floating main body; or in a vertical position to extend downward beyond the bottom surface of the floating main body.

According to the motion reduction apparatus, when there are no interfering objects nearby, the swing plate can be moved to the horizontal position to reliably reduce motion of the floating main body, while when there are interfering objects nearby, the swing plate can be positioned vertically to reliably reduce motion of the floating main body. Further, when not in use, the swing plate can be raised to the retracted position so as to prevent interference.

In an eleventh aspect of the invention, the motion reduction apparatus for a floating body comprises a water surface plate provided at least on either a front section or a back section of a floating main body having an orthorhombic shape in disposed along a water surface.

According to the motion reduction apparatus, when the incoming waves impact on the front section or the back section of the floating main body, the horizontal plate and the flow sections offer resistance to suppress rolling motion to enable to reliably reduce motion of the floating main body.

In a twelfth aspect of the invention, the motion reduction apparatus for a floating body comprises a plate member provided at least on a wavefront side of a floating main body disposed in such a way that an edge section of the plate member proximal to the floating main body is separated from the floating main body by a specific distance.

According to the motion reduction apparatus, the incoming waves impact on the floating main body and the plate member while some of the incoming waves flood through the flow sections, so that the wave energy acting on the floating main body can be reduced, and the plate member can suppress rolling or pitching motion so as to reliably reduce motion of the floating body to improve the safety of operation of the floating body.

In a thirteenth aspect of the invention, the plate member is disposed so as to be inclined at an angle with respect to a bottom surface of the floating main body.

According to the motion reduction apparatus, incoming waves impact on the floating main body and the plate member while some of the incoming waves flood through the flow sections to reduce the wave energy acting on the floating main body and the plate member enables to suppress rolling or pitching motion so that motion of the floating body can be reliably reduced to improve the safety of operation of the floating body. Further, the angle of the plate member can be changed to maximize the reduction of rolling or pitching motion according to the cresting period of the incoming waves.

In a fourteenth aspect of the invention, the plate member is supported at a specific location of the floating main body by means of a plurality of stay members arranged in parallel on the floating main body so as to provide flow sections between the stay members for flooding with incoming water.

According to the motion reduction apparatus, the plate member can be supported at a specific position using a simple structure.

In a fifteenth aspect of the invention, the floating main body is orthorhombic-shaped, and the plate member is provided along the longitudinal direction at least on either a left side section or a right side section of the floating main body.

According to the motion reduction apparatus, the plate member can reliably suppress rolling motion of the floating main body.

In a sixteenth aspect of the invention, the plate member is constructed so as to be retractable above a bottom surface of the floating main body.

According to the motion reduction apparatus, when the floating main body is adopted to a platform work ship, for example, interference with cruising operation of the ship can be avoided by raising the horizontal plate above the floating main body when not in use.

In a seventeenth aspect of the invention, the plate member is supported vertically by hinging means.

According to the motion reduction apparatus, incoming waves impact on the floating main body and the plate member while some of the incoming waves flood through the flow sections to reduce the wave energy acting on the floating main body and the plate member absorbs wave energy to enable to suppress rolling or pitching motion so that motion of the floating body can be reliably reduced to improve the safety of operation of the floating body.

In an eighteenth aspect of the invention, the plate member is supported on the hinging means arranged on the floating main body in parallel, and flow sections are provided in the hinging means for flooding with incoming water.

According to the motion reduction apparatus, the plate member can be supported using a simple structure.

In a nineteenth aspect of the invention, the motion reduction apparatus for a floating body floating on water comprises an L-shaped plate member provided at least on a front section or a back section of a floating main body and disposed in such a way that the horizontal portion of the L-shaped plate member faces outward, and that the bottom surface of the L-shaped plate member is situated below the water level.

According to the motion reduction apparatus, when the incoming waves impact on the front or back section of the floating main body, the plate member and the flow sections offer resistance to suppress pitching motion so as to reliably reduce motion of the floating body to provide safety of operation of the floating body.

In a twentieth aspect of the invention, the motion reduction apparatus for a floating body floating on water having a floating main body of an orthorhombic shape comprises a water surface plate along a water surface or an outwardly extending L-shaped plate member, disposed on either a front section or a back section of the floating main body, to extend in a longitudinal direction in such a way that a bottom section of the L-shaped plate member is situated below the water surface.

According to the motion reduction apparatus, when the incoming waves impact on the front or back section of the floating main body, the plate member and the flow sections offer resistance to suppress pitching motion so as to reliably reduce motion of the floating body to provide safety of operation of the floating body.

In a twenty-first aspect of the invention, the plumb plate is subdivided by gaps formed substantially at right angles to a direction extending from the plumb plate.

According to the motion reduction apparatus, similar to the case of providing a solid plumb plate, incoming waves impact on the floating main body and the plumb plate while some of the incoming waves flood through the flow sections so that the wave energy acting on the floating main body can be reduced and the plumb plate suppresses rolling or pitching motion so as to reliably reduce motion of the floating body and to improve the safety of operation of the floating body.

In a twenty-second aspect of the invention, the horizontal plate is subdivided by gaps formed substantially at right angles to a direction extending from the horizontal plate.

According to the motion reduction apparatus, similar to the case of providing a solid horizontal plate, incoming waves impact on the floating main body and the horizontal plate while some of the incoming waves flood through the flow sections so that the wave energy acting on the floating main body can be reduced and the horizontal plate suppresses rolling or pitching motion so as to reliably reduce motion of the floating body and to improve the safety of operation of the floating body.

In a twenty-third aspect of the invention, the plate member is subdivided by gaps formed substantially at right angles to a direction extending from the plate member.

According to the motion reduction apparatus, similar to the case of providing a solid plate member, incoming waves impact on the floating main body and the plate member while some of the incoming waves flood through the flow sections so that the wave energy acting on the floating main body can be reduced and the plate member suppresses rolling or pitching motion so as to reliably reduce motion of the floating body and improving the safety of operation of the floating body.

According to twenty-fourth aspect of the invention, a motion reduction apparatus for a column-shaped floating body has a motion reduction plate disposed on an outer periphery of the floating main body approximately at the same height as a bottom section of the floating main body.

According to the motion reduction apparatus, incoming waves impact not only on the floating main body and the motion reduction plate but the characteristic pitching and rolling periods are also shifted to a longer period so that the wave energy acting on the floating main body can be reduced so as to reliably reduce motion of the floating body to improve the safety of operation of the floating body.

In a twenty-fifth aspect of the invention, the floating main body is hollow, and a motion reduction plate is provided on the outer as well as on the inner periphery of the floating main body at approximately the same height as the bottom section of the floating main body.

According to the motion reduction apparatus, incoming waves impact on the floating main body and the motion reduction plate and the characteristic pitching and rolling periods are shifted to a longer period so that the wave energy acting on the floating main body can be reduced even more than the in the floating body recited in aspect twenty-four so as to reliably reduce motion of the floating body to improve the safety of operation of the floating body.

A floating body relating to the present invention has a floating main body and a motion reduction apparatus according to any one of the motion reduction apparatuses disclosed in aspects 1 to 25.

According to the floating body, high safety of operation of the floating body can be realized because of the reduction in motion achieved by the motion reduction plates.

BRIEF DESCRIPTION OF THE DRAWINGS

FIG. 26 is a table showing the conditions for the motion reduction apparatus for each floating body shown in FIG. 25.

DESCRIPTION OF THE PREFERRED EMBODIMENTS

Preferred embodiments will be explained in detail in the following with reference to the drawings.

Figure 1:
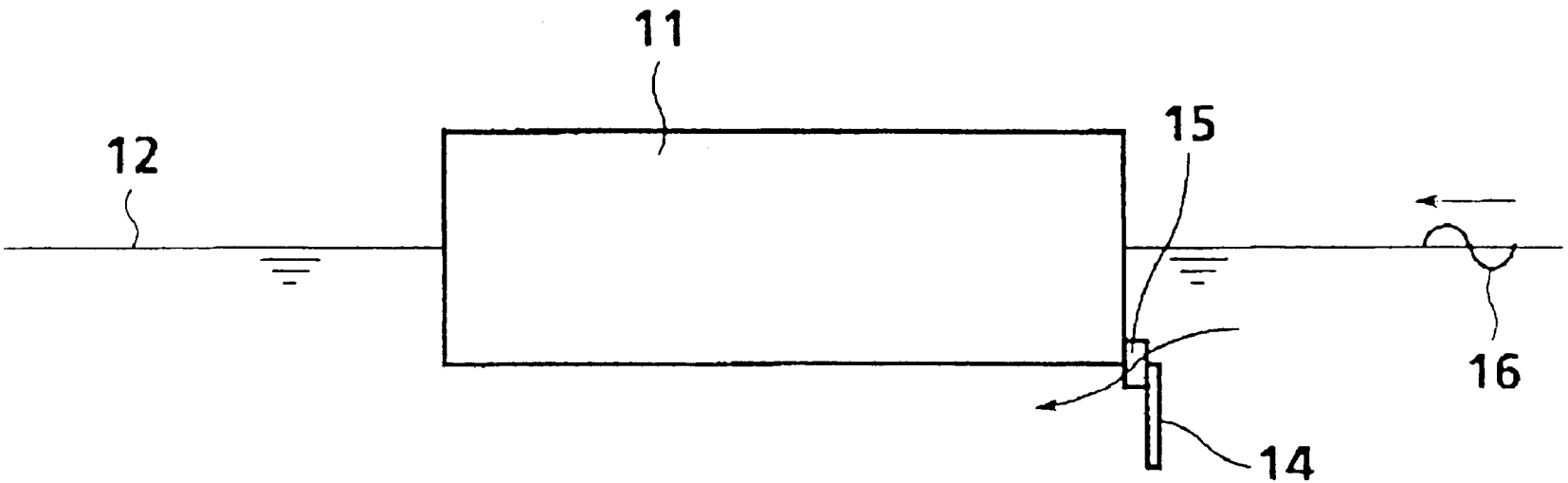
FIG. 1 is a schematic diagram of a motion reduction apparatus for a floating body in a first embodiment of the present invention.
Figure 2:
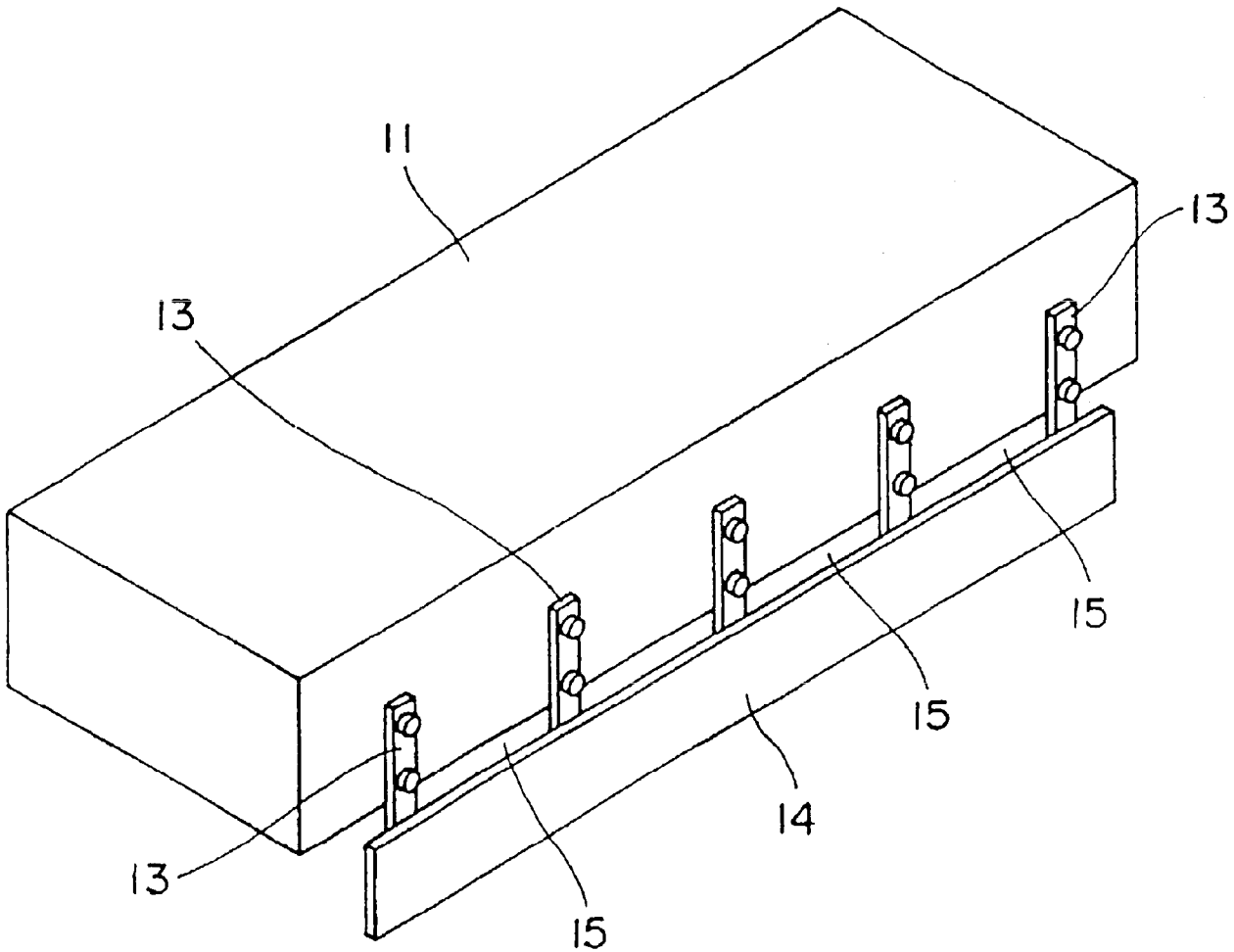
FIG. 2 is a schematic diagram of a floating main body showing an attaching structure of a plumb plate.

The floating body motion reduction apparatus in the first embodiment will be explained along with FIGS. 1 to 6. As shown in FIGS. 1 and 2, in the floating body motion reduction apparatus in this embodiment, the floating main body 11 is made with steel plates, for example, into an orthorhombic shaped structural body, and the interior space is made into a number of floating chambers (omitted from the diagram). The floating main body 11 is, therefore, able to float above the waterline 12 due to the lifting force generated by the floating chambers.

On one lateral side in the longitudinal direction of the floating main body 11, i.e., the side surface, a plumb plate 14 is supported on the side surface separated at a distance from the floating main body 11, by means of a plurality of stay plates 13 at approximately in the vertical direction. The plumb plate 14 is made of a flat plate and has essentially the same longitudinal dimension as the floating main body 11, and the upper edge of the plate 14 is at the same level as the bottom surface of the floating main body 11, from which it extends downward beyond the bottom surface. A plurality of flow sections 15 that can flow through the flooding water are formed in the space bounded by the floating main body 11 and the plumb plate 14 by the plurality of stay plates 13 forming the boundaries.

When the floating main body 11 having the plumb plate 14 constructed in such a manner and floating on the water surface is impacted by incoming waves 16 from the wave-front side (right side in FIG. 1), not only the side surface and the plumb plate 14 of the floating main body 11 are impacted, but also some of the waves 16 flood through each flow section 15. In so doing, wave energy is expended in the flow sections 16. Also, the plumb plate 14 not only provides resistance to rolling of the floating body 11 but also magnifies the resistive forces because of the flooding of water through the flow sections 15. Motion of the floating main body 11 is thus reduced.

Figure 3:
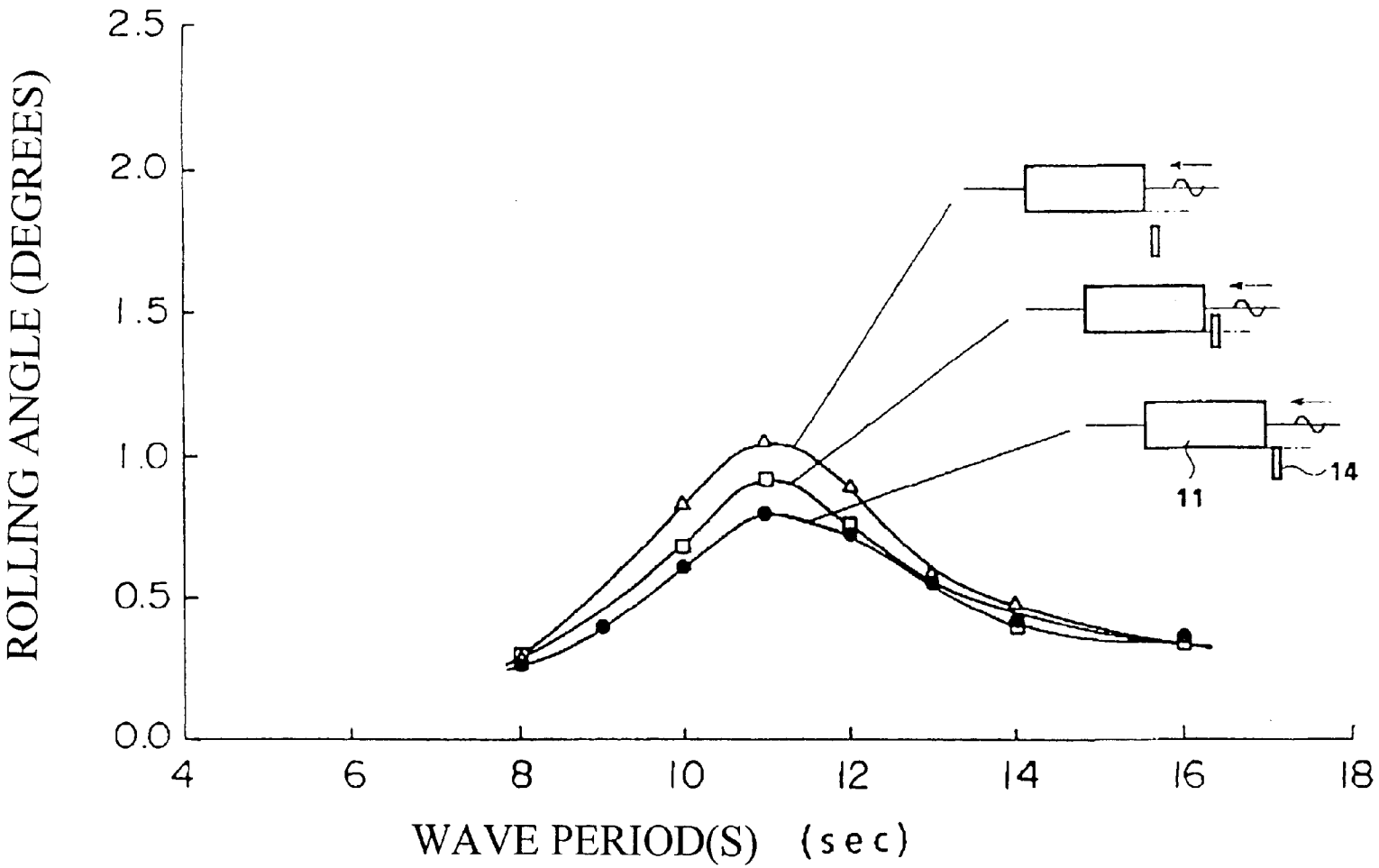
FIG. 3 is a graph of rolling amplitude of the floating main body and the wave for different heights of attaching the plumb plate in a variation of the embodiment shown in FIGS. 1 and 2.

In such a case, the degree of motion reduction varies depending on the vertical positioning of the plumb plate 14 relative to the floating main body 11. FIG. 3 shows a graph of wave period and rolling amplitude of the floating main body in three cases: (1) when the upper edge of the plumb plate 14 is below the bottom surface of the floating main body 11; (2) when the upper edge of the plumb 14 is above the bottom surface of the floating main body 11; and (3) when the upper edge of the plumb plate 14 is at about the same level as the bottom surface of the floating main body 11. As can be understood from FIG. 3, the rolling amplitude of the floating main body 11 is smallest when the bottom surface of the floating main body 11 is at the same level as the upper edge of the plumb plate 14, thereby reliably effecting a reduction in motion of the floating main body 11.

Figure 4:
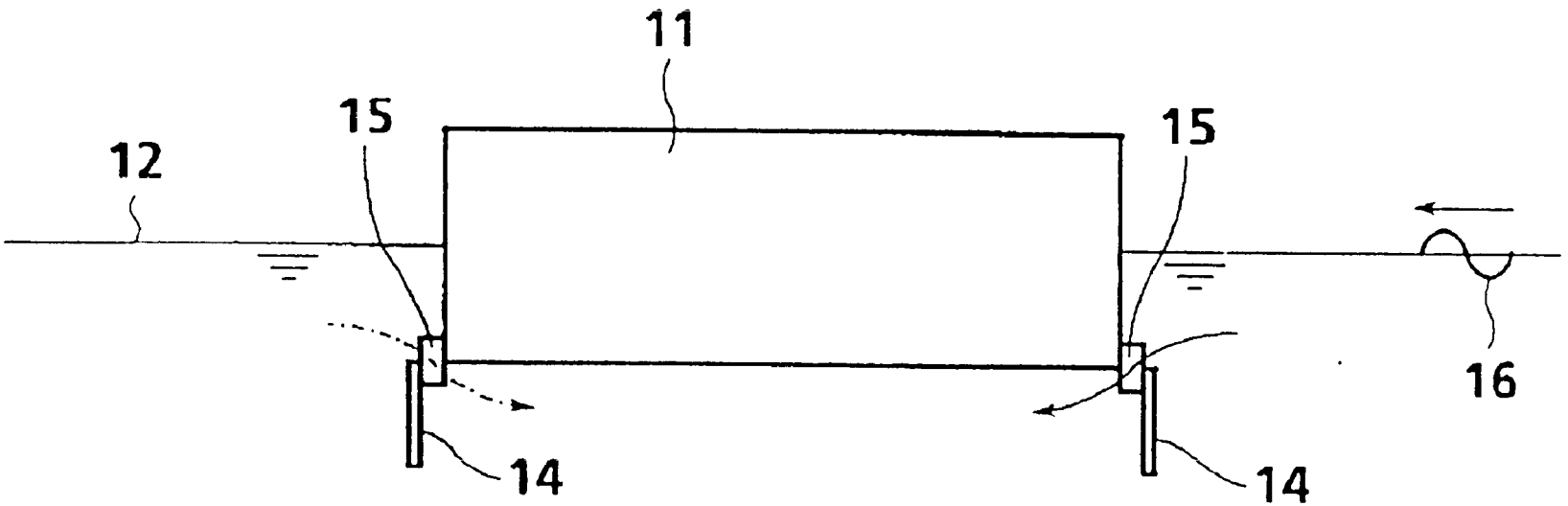
FIG. 4 is a schematic diagram of a motion reduction apparatus for a floating body in a variation of the first embodiment.

It should be noted that, in the embodiment described above, the plumb plate 14 is provided on one side section with intervening stay plates 13, but the plumb plate 14 may be provided on both left and right side sections of the floating main body 11 with intervening stay plates 13, as shown in FIG. 4. Depending on the orientation of the floating main body 11, waves may impact from either left or right side of the floating main body 11, but in such a case, by providing plumb plates 14 on both side sections of the floating main body 11, rolling of the floating main body 11 against incoming waves 16 can be suppressed and motion of the floating main body 11 can be reduced.

Figure 5:
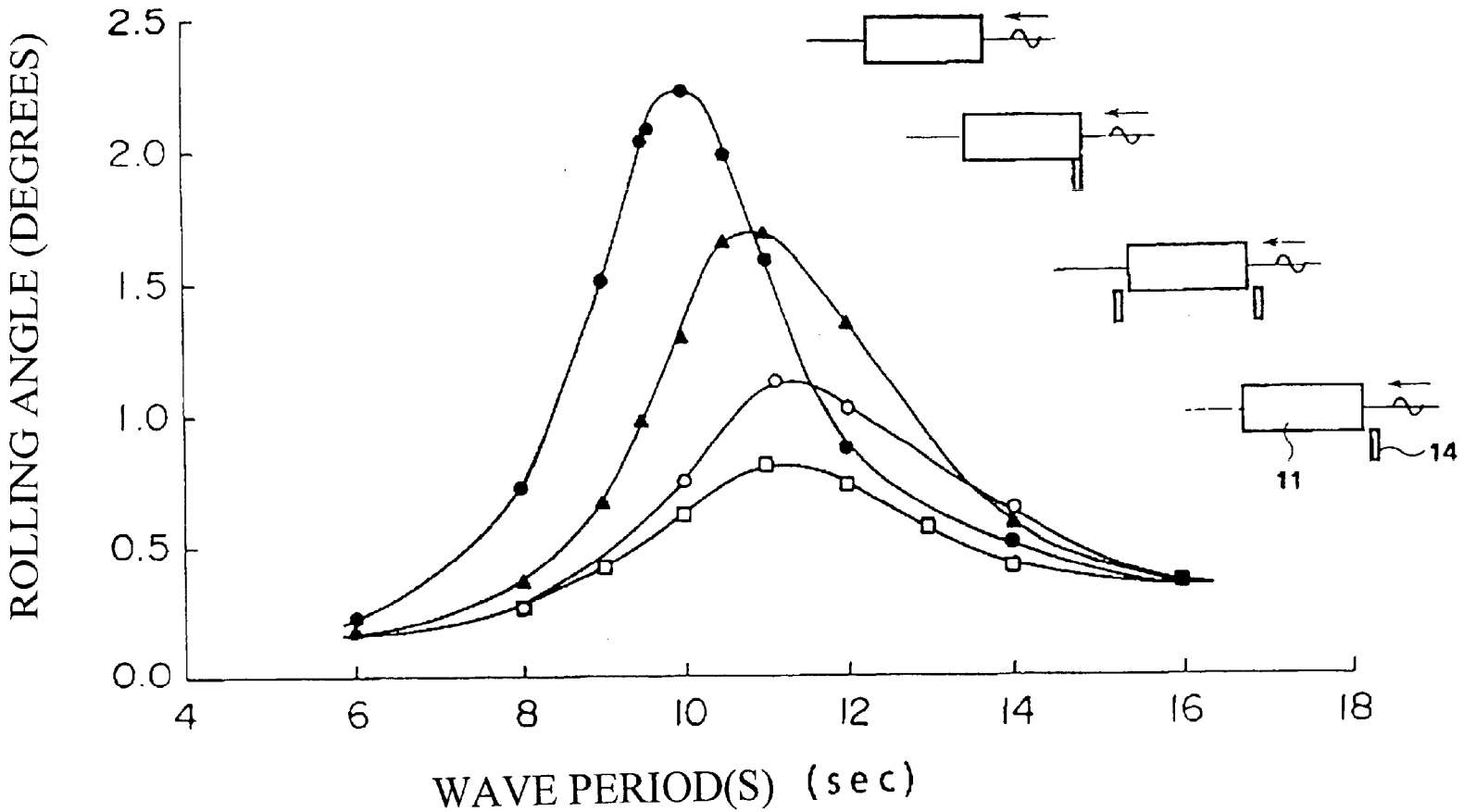
FIG. 5 is a graph of rolling amplitude of the floating main body and the wave period in the motion reduction apparatus for a floating body shown in FIG. 4.

Accordingly, in this embodiment, by providing a plumb plate 14 on one side section or both side sections of the floating main body 11 with intervening flow sections 15, motion of the floating main body 11 can be reduced reliably. FIG. 5 shows a graph of comparison of the wave period and the rolling amplitude of the floating main body 11 for the cases of: (1) floating main body by itself; (2) affixing a plumb plate on one side section only; (3) affixing a plumb plate 14 on one side section with intervening flow sections 15 (this embodiment); and (4) affixing a plumb plate on each side section with intervening flow sections 15 (a first variation of the embodiment). As can be understood from FIG. 5, the floating main body 11 having one plumb plate 14 on each side surface with intervening flow sections 15 produces smaller rolling amplitudes compared with floating main body by itself or floating main body and plumb plates, and the characteristic rolling period shifts to a longer period to reliably reduce motion of the floating main body 11. Further, it can be seen that the motion reduction effect is enhanced in a floating main body 11 having a plumb plate 14 on one side section with intervening flow sections 15.

Figure 6:
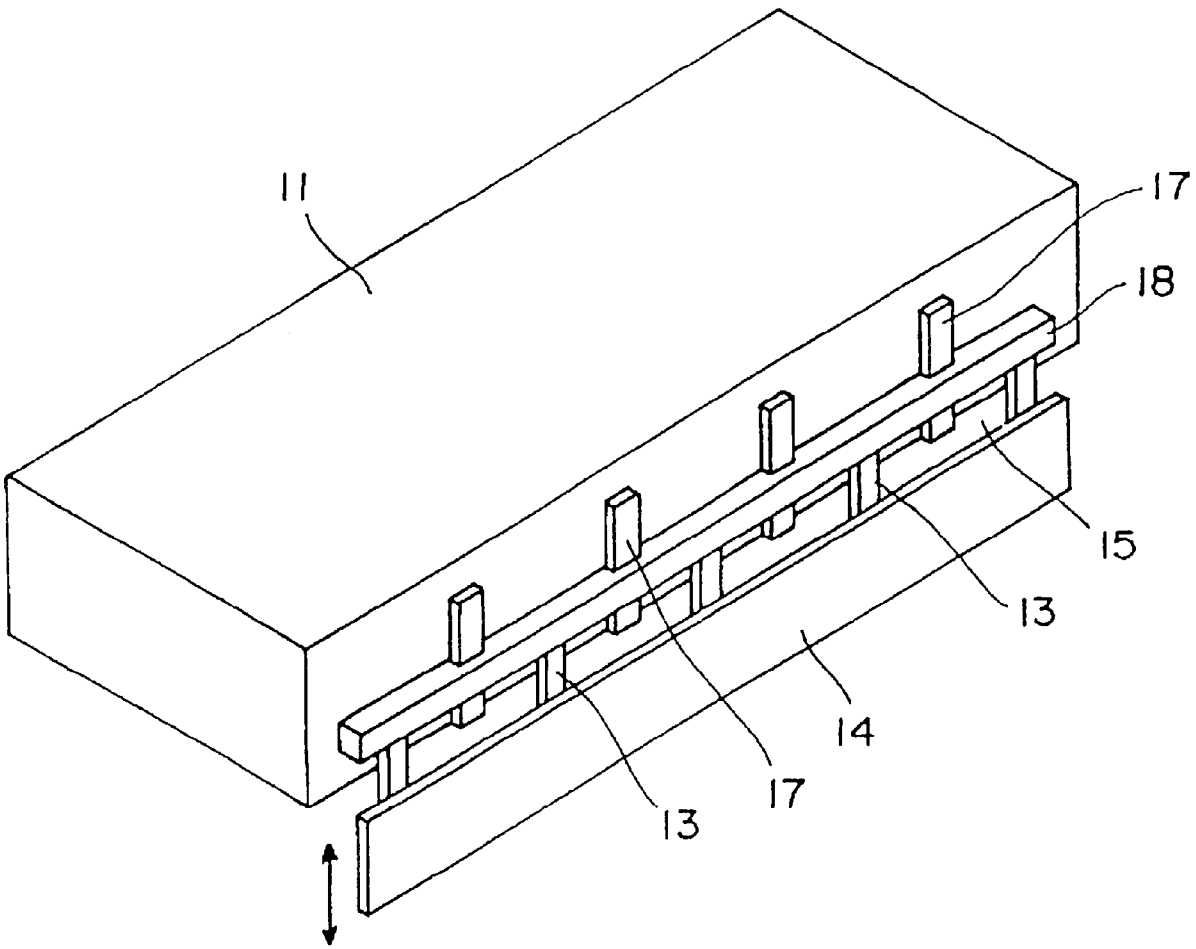
FIG. 6 is a schematic diagram of a motion reduction apparatus in the variation of the first embodiment.

It should be noted that, although in the embodiment described above, the plumb plate 14 was fixed to one side section of the floating main body 11 with intervening stay plates 13, but as shown in FIG. 6, a plurality of guide rails 17 may be affixed vertically to one side section of the floating main body 11, and the guide member 18 is freely elevatably supported on the guide rails 17, and the plumb plate 14 is supported with intervening stay plates 13 on the guide member 18 so that the guide member 18 can be moved vertically by driving means (not shown but can be a chain drive, screw drive, fluid cylinder drive and the like).

In this example, the plumb plate 14 is freely vertically movable with respect to the floating main body 11 so that, in the raised position, the lower edge of the plumb plate 14 retracts above the bottom surface of the floating main body 11. Therefore, when the floating main body 11 is adopted to a platform work ship, the plumb plate 14 does not interfere with the cruising operation of such a ship. On the other hand, when the plumb plate 14 is in the down position, the upper edge of the plumb plate 14 and the bottom surface of the floating main body 11 are at about the same level so that the rolling motion of the floating main body 11 due to incoming waves 16 is suppressed, and motion of the floating main body 11 is reduced.

A second embodiment of the motion reduction apparatus will be explained along with FIGS. 7 to 10. The parts in this embodiment having the same function as those in the first embodiment will be referred to by the same reference numerals, and their explanations will be omitted.

Figure 7:
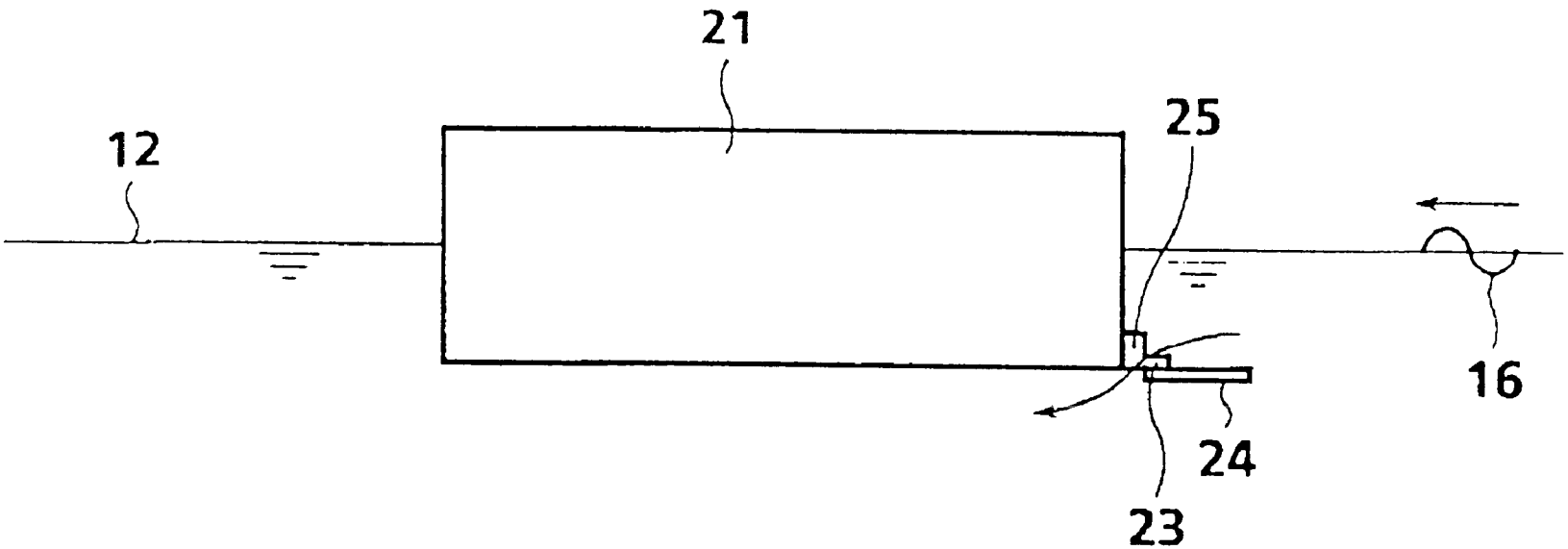
FIG. 7 is a schematic diagram of a motion reduction apparatus for a floating body in a second embodiment of the present invention.

As shown in FIG. 7, the motion reduction apparatus in this embodiment has a floating main body 21 of a similar construction as the floating main body 11 in the preceding embodiment, and on one lateral surface on the longitudinal direction, i.e., the side section supports a horizontal plate 24 substantially in the horizontal direction with intervening stay plates 23 at a distance away from the floating main body 21. The horizontal plate 24 is made of plate of about the same dimension as the floating main body 21 in the longitudinal direction, and its upper surface section is at about the same level as the bottom surface of the floating main body 21, and a plurality of flow sections 25 are formed by the stay plates 23 between the floating main body 21 and the horizontal plate 24 in such a way that water can flood through.

When the floating main body 21 having the horizontal plate 24 constructed in such a manner and floating on water is impacted by incoming waves 16 from the wavefront side (right side in FIG. 7), the incoming waves 16 not only hit the side surface of the floating main body 21 but also some of the waves 16 flood through each flow section 25. In so doing, wave energy is expended in the flow sections 25 of the floating main body 21. Also, the horizontal plate 24 not only provides resistance to rolling of the floating body 21 but rolling motion is reduced because of the resistive forces produced by the flooding of fluid through the flow sections 25. Motion of the floating main body 21 is thus reduced.

Figure 8:
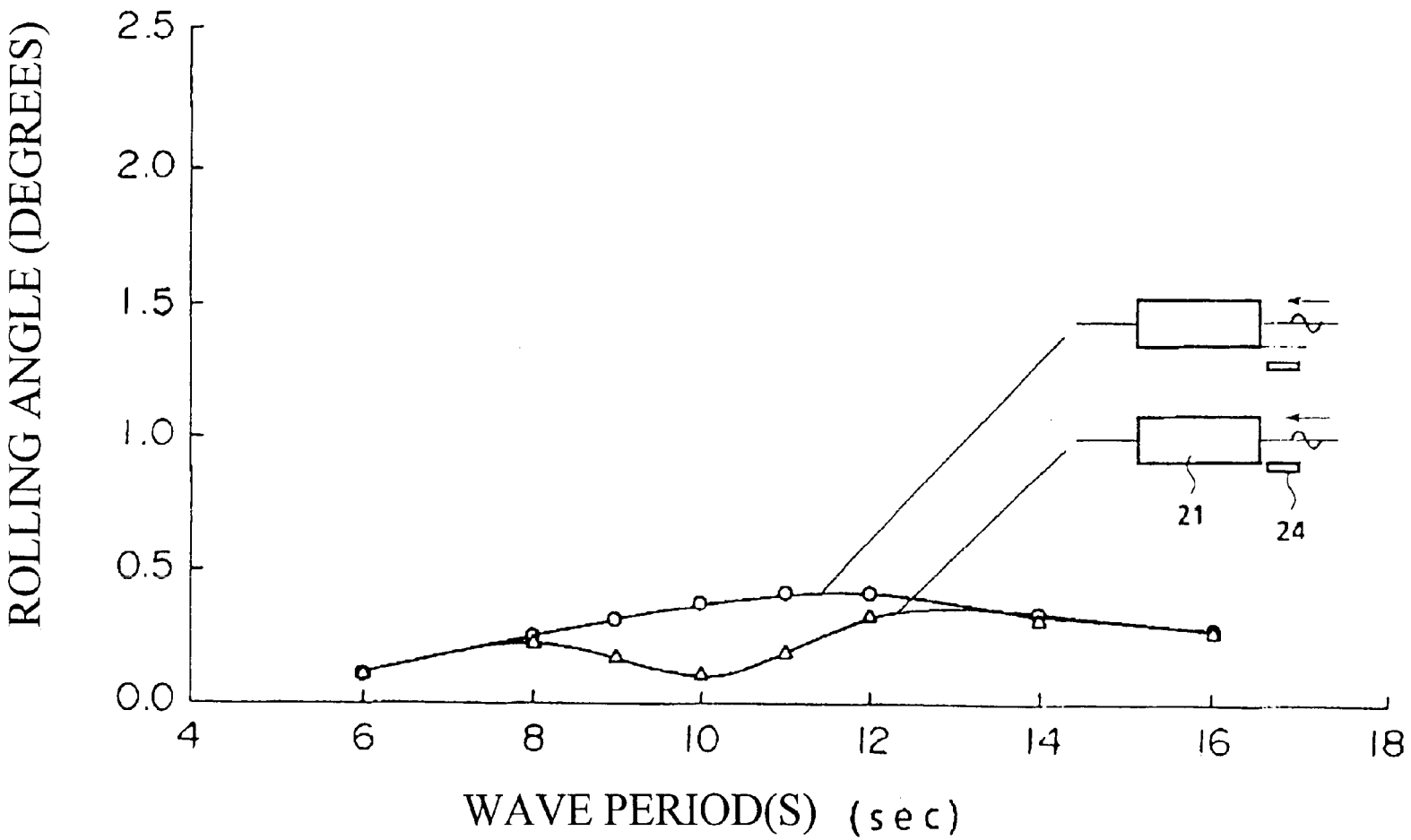
FIG. 8 is a graph of rolling amplitude of the floating main body and the wave period for different heights of attaching the horizontal plate in a variation of the embodiment shown in FIG. 7.

In such a case, the degree of motion reduction varies depending on the vertical positioning of the horizontal plate 24 relative to the floating main body 21. FIG. 8 shows a graph of comparison of the wave period and rolling amplitude of the floating main body in two cases: (1) when the upper edge of the horizontal plate 24 is below the bottom surface of the floating main body 21; and (2) when the upper edge of the horizontal plate 24 is at about the same level as the bottom surface of the floating main body 21. As can be understood from FIG. 8, the rolling amplitude of the floating main body 21 is smaller when the bottom surface of the floating main body 21 is at the same level as the upper edge of the horizontal plate 24, thereby reliably effecting a reduction in motion of the floating main body 21.

Figure 9:
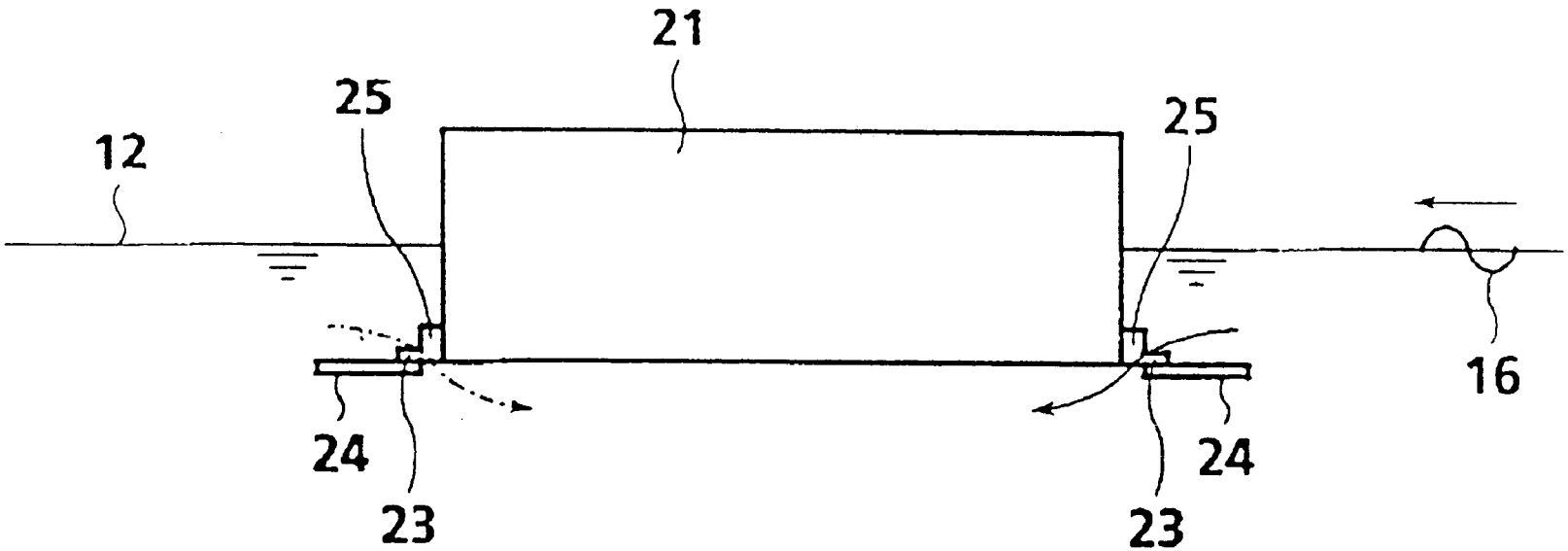
FIG. 9 is a schematic diagram of a variation of the motion reduction apparatus for a floating body in the second embodiment.

It should be noted that, in the embodiment described above, the horizontal plate 24 is provided with intervening stay plates 23, but the horizontal plate 24 may be provided on both left and right side sections of the floating main body 21 with intervening stay plates 23, as shown in FIG. 9. Depending on the orientation of the floating main body 21, waves may impact from either left or right side of the floating main body 21, but in such a case, by providing horizontal plate 24 on both side sections of the floating main body 21, rolling of the floating main body 21 against incoming waves can be suppressed and motion of the floating main body 21 can be reduced.

Figure 10:
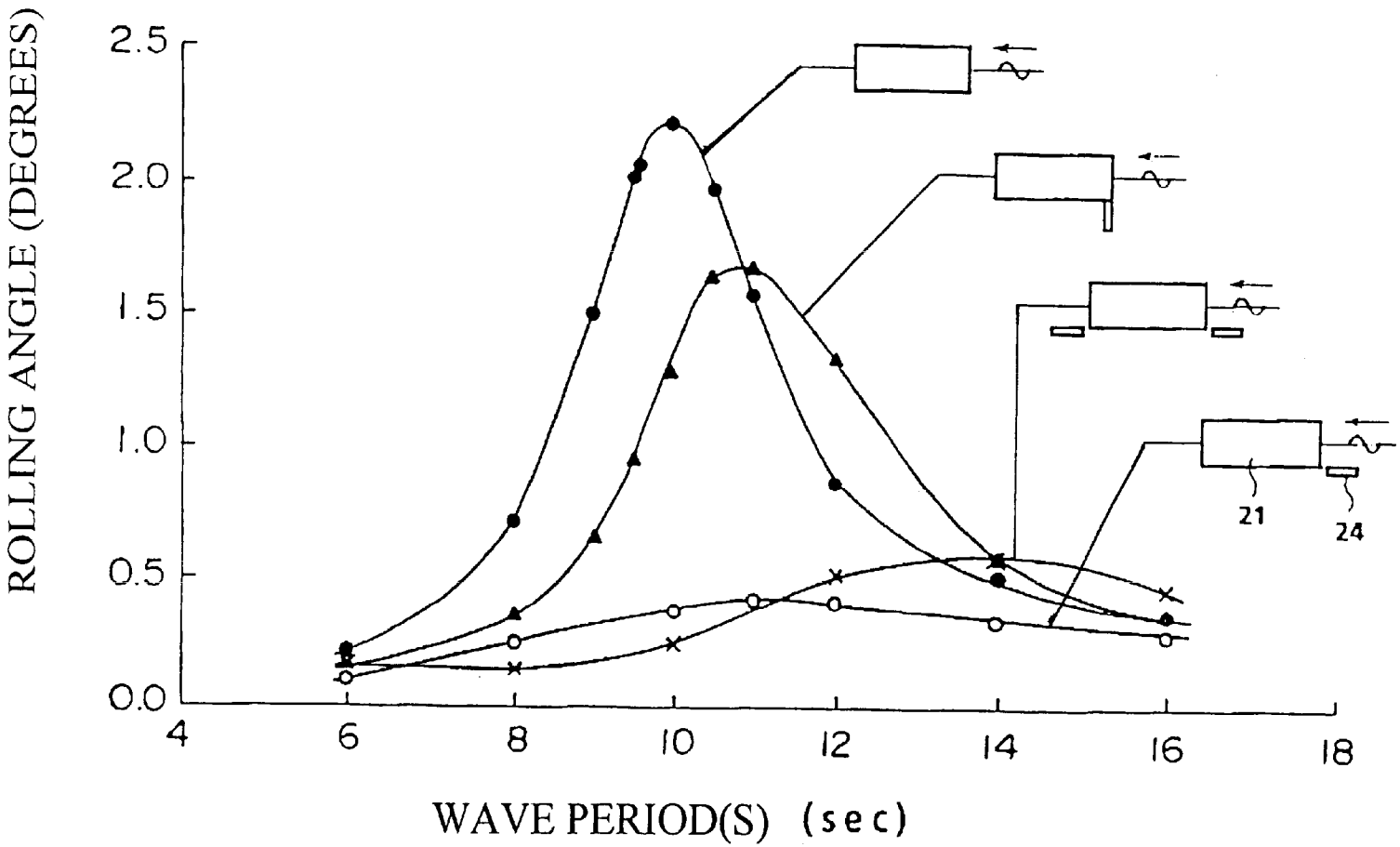
FIG. 10 is a graph of rolling amplitude of the floating main body and the wave period for different heights of attaching the horizontal plate in the motion reduction apparatus shown in FIG. 9.

Accordingly, in this embodiment, by providing a horizontal plate 24 on one side section or both side sections of the floating main body 21, with intervening flow sections 25, motion of the floating main body 21 can be reduced reliably. FIG. 10 shows a graph of comparison of the wave period and the rolling amplitude of the floating main body 21 for the cases of: (1) floating main body by itself; (2) affixing a plumb plate on one side section only; (3) affixing a horizontal plate 24 on one side section with intervening flow sections 25 (this embodiment); and (4) affixing a horizontal plate on both side sections with intervening flow sections 25 (a first variation of this embodiment). As can be understood from FIG. 10, the floating main body 21 having one horizontal plate 24 on both side sections with intervening flow sections 25 produces smaller rolling amplitudes compared with floating main body by itself or floating main body with a plumb plate, and the characteristic wave period shifts to a longer period to reliably reduce motion of the floating main body 21. Further, it can be seen that the motion reduction effect is enhanced in a floating main body 21 having a horizontal plate 24 on one side section with intervening flow sections 25.

Figure 11:
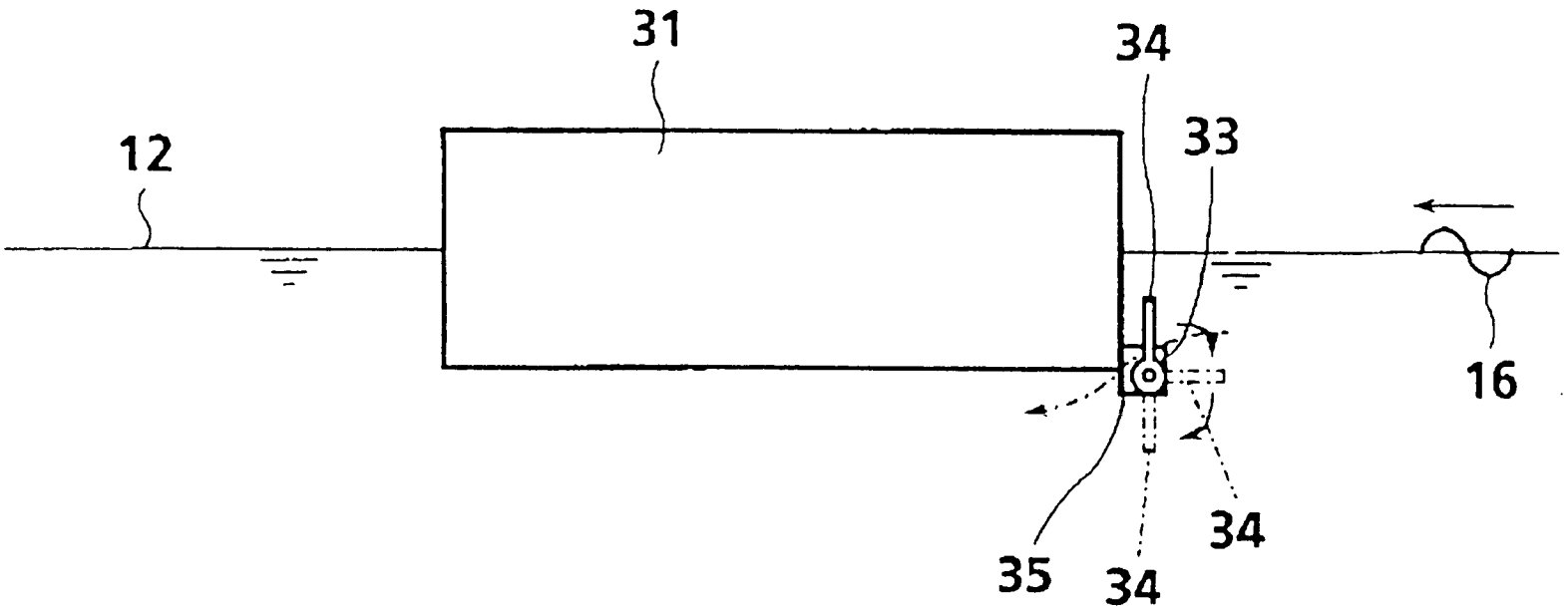
FIG. 11 is a schematic diagram of a third embodiment of the motion reduction apparatus for a floating body.

FIG. 11 shows a third embodiment of the motion reduction apparatus. As shown in FIG. 11, the floating main body 31 in this motion reduction apparatus is constructed substantially the same as the floating main body 11 or 21 in the preceding embodiments, but the longitudinal lateral surface, i.e., the side surface supports a freely pivoting swing plate 34 at a given distance away from the floating main body 31 by way of a plurality of brackets 33. The swing plate 34 can swing by operating a drive device (not shown), and is able to be positioned in three positions: (1) a retreat position situated above the bottom surface of the floating main body 31 (solid line in FIG. 11); (2) a horizontal position at about the same level as the bottom surface of the floating main body 31 (double-dot?? single-dot line in FIG. 11); and (3) a plumb position extending beyond the bottom surface of the floating main body 31 (single-dot line in FIG. 11). Also, water is able to flow through the flow sections 35 formed between the floating main body 31 and the swing plate 34 when the floating main body 31 is in the plumb position.

Therefore, when the floating main body 31 having the swing plate 34 constructed in such a manner and floating on water is impacted by incoming waves 16 from the wavefront side (right side in FIG. 11), when the swing plate 34 is in the horizontal position, the incoming waves 16 not only hit the side surface of the floating main body 31, but also the swing plate 34 generates resistance, thereby reducing rolling and motion of the floating main body 31. Also, when the swing plate 34 is in the plumb position, the incoming waves 16 not only hit the side surface of the floating main body 31 and the swing plate 34 but also some of the waves 16 flood through each flow section 35, so that the wave energy is expended in the process, and the swing plate 34 reduces rolling and motion of the floating main body 31.

Further, because the swing plate 34 is able to be situated in the retreat position and the plumb position, when the floating main body 31 is adopted to a platform work ship, by locating the swing plate 34 in the retreat position during cruising, the swing plate 34 does not interfere with the operation of such a ship. Also, when there are no obstacles in the vicinity (break wall or other cruising ships), by swinging the swing plate 34 to the horizontal position, motion of the floating main body 31 is reduced reliably. If there is an obstacle in the vicinity (break wall or other cruising ships), by swinging the swing plate 34 into the plumb position, motion of the floating main body 31 can be reduced reliably without interfering with the surrounding matters. Here also, it is preferable to position the upper surface of the horizontally oriented swing plate 34 at about the same level as the bottom surface of the floating main body 31, and to position the upper edge of the vertically oriented swing plate 34 at about the same level as the bottom surface of the floating main body 31.

It should be noted that, in the above embodiment, the swing plate 34 is provided on one side section of the floating main body 31, but the swing plate 34 may be provided on both side sections of the floating main body 31.

It should also be noted that, in the preceding embodiments, a plumb plate 14, horizontal plate 24 or swing plate 34 is provided on the side section of the floating main body 11, 21 or 31, to suppress rolling motion, but a plumb plate 14, horizontal plate 24 or swing plate 34 may also be provided on front and/or back sections of the floating main body 11, 21 or 31 to suppress pitching of the floating main body 11, 21 or 31.

Figure 12:
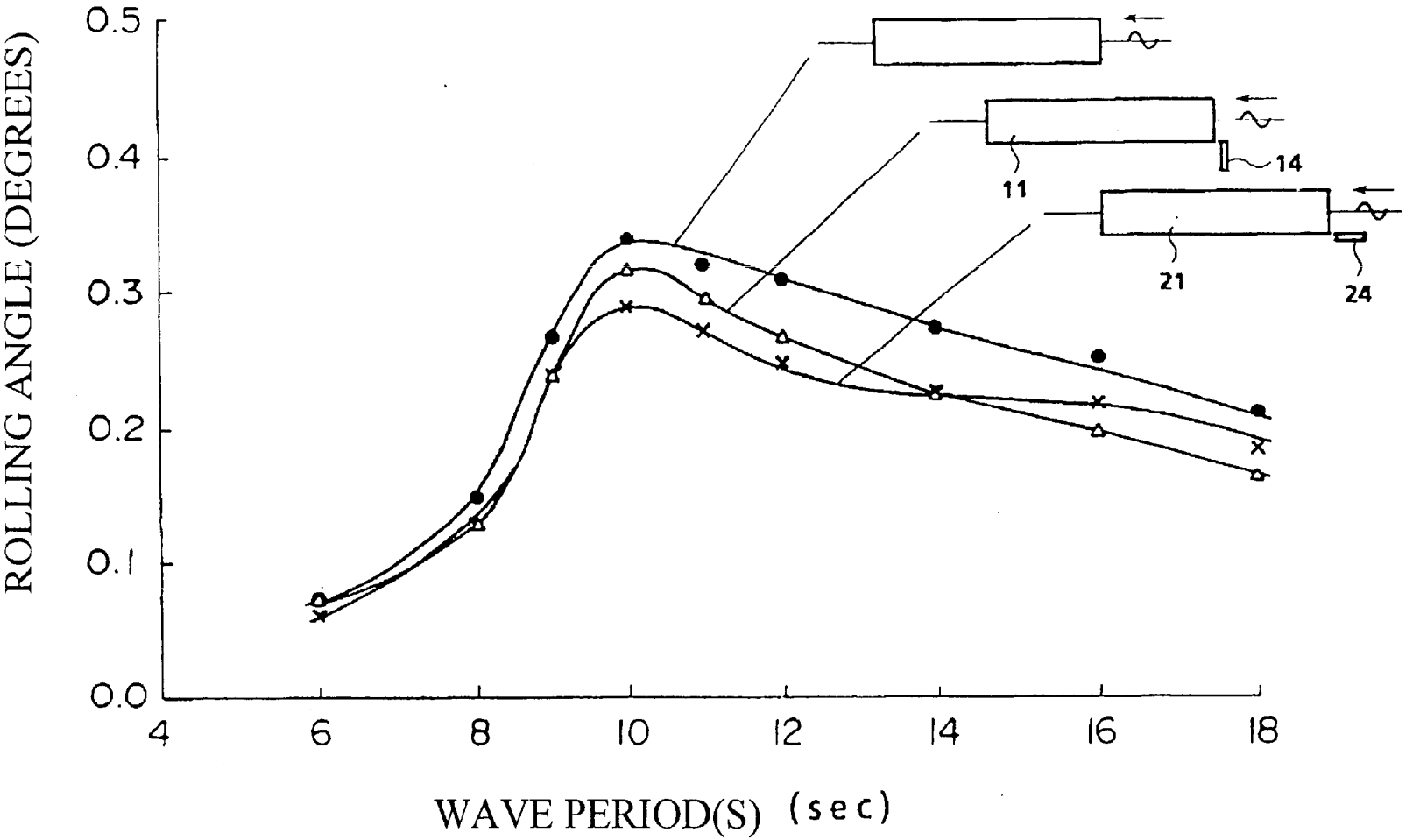
FIG. 12 is a graph of pitching amplitude and the wave period in the motion reduction apparatus for a floating body shown in FIG. 11.

FIG. 12 shows a graph of comparison of wave period and rolling amplitude of the floating main body for the cases of: (1) floating main body by itself; (2) affixing a plumb plate 14 on the front section of the floating main body 11 with intervening flow sections 15; and (3) affixing a horizontal plate 24 on the front section of the floating main body 21 with intervening flow sections 25. As can be understood from FIG. 12, the floating main body 11 having one plumb plate 14 on the front section and the floating main body 21 having one horizontal plate 24 on the front section produce smaller pitching amplitudes of the floating body 11 or 21 compared with floating main body by itself to reliably reduce motion of the floating main body 11 or 21.

Figure 13:
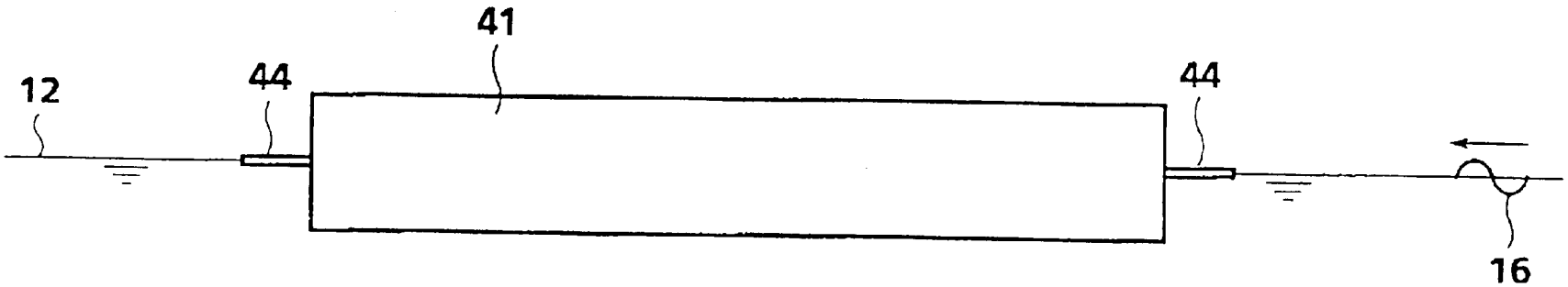
FIG. 13 is a schematic diagram of a fourth embodiment of the motion reduction apparatus for a floating body.

A fourth embodiment of the motion reduction apparatus will be explained along with FIGS. 13 and 14. The motion reduction apparatus in this embodiment has a floating main body 41 of a similar structure to the floating main body 11, 21, or 31 provided with a water surface plate 44 fixed to the front end and back end sections parallel to the water surface in the longitudinal direction.

When the floating main body 41 having such a water surface plate 44 floating on the water is impacted (right side in FIG. 13) by the incoming waves 16, the incoming waves 16 hit the front plane of the floating main body 41, but the water surface plate 44 provides resistance to suppress pitching of the floating main body 41, thus reducing motion of the floating main body 41.

Figure 14:
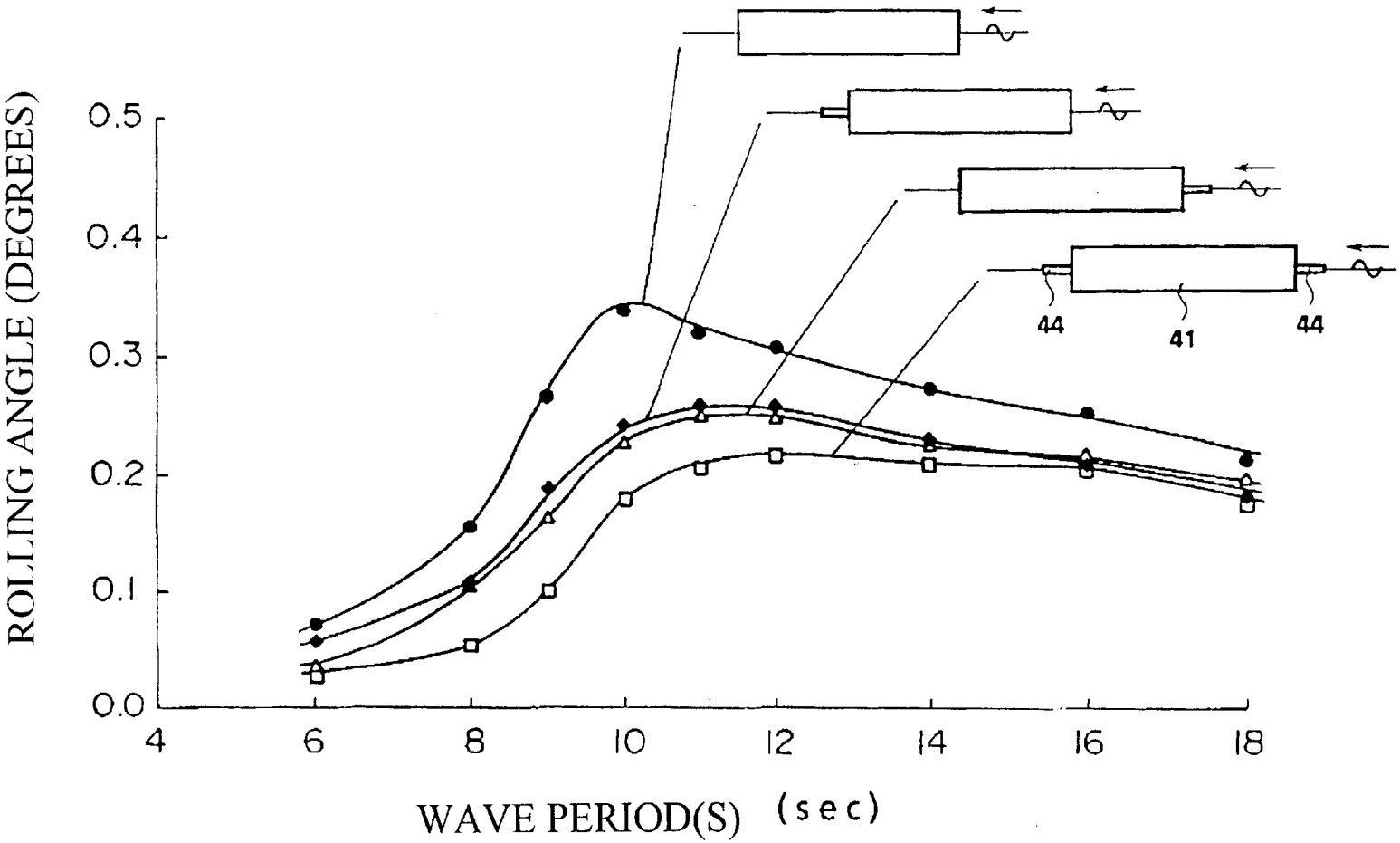
FIG. 14 is a graph of pitching amplitude and the wave period in the motion reduction apparatus for a floating body shown in FIG. 13.

FIG. 14 shows a graph of comparison of wave period and pitching amplitude of the floating main body in the cases of: (1) floating main body by itself; (2) affixing the water surface plate 44 on either the front end section or the back end section of the floating main body 41; and (3) affixing the water surface plate 44 on the front and back sections of the floating main body 41. As can be understood from FIG. 14, the floating main body having the water surface plate 44 fixed to either the front end section or the back end section show reduced pitching amplitudes compared to the floating main body by itself, to reliably reduce motion of the floating main body 41. Further, when the water surface plate 44 is affixed to the front and back end sections of the floating main body 41, pitching amplitude of the floating main body 41 is reduced even more, and motion of the floating main body 41 is further reduced reliably.

Figure 15:
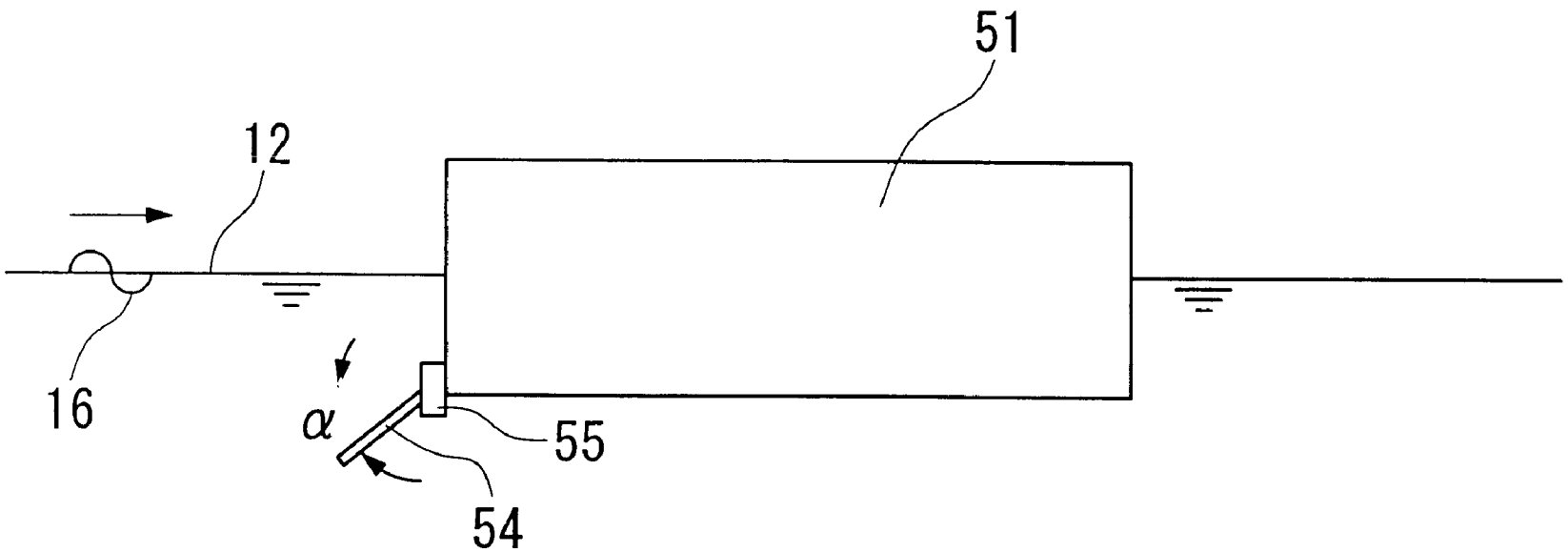
FIG. 15 is a schematic diagram of a fifth embodiment of the motion reduction apparatus for a floating body.
Figure 16:
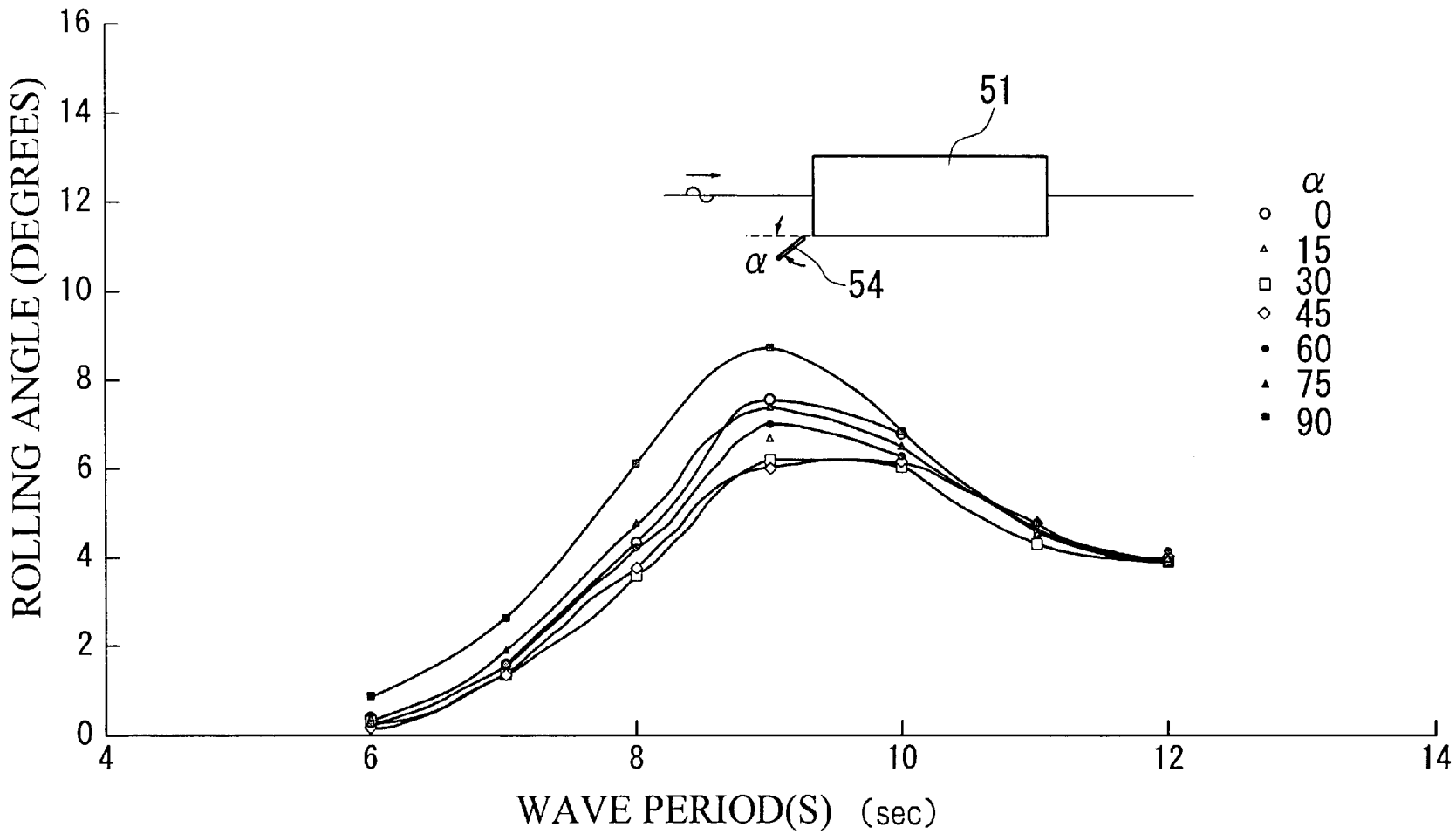
FIG. 16 is a graph of rolling amplitude of the floating body and the wave period for different angles of attaching the plate member in the motion reduction apparatus for a floating body shown in FIG. 15.

A fifth embodiment of the motion reduction apparatus will be explained along with FIGS. 15 and 16. As shown in FIG. 15, the motion reduction apparatus in this embodiment has a floating main body 51 of a similar structure to the floating main body 11 provided with a plate-shaped member 54 fixed to one lateral side, i.e., the side section, at an angle to the bottom surface of the floating main body 51 and separated from the floating main body 51 at a given distance. The plate-shaped member 54 is comprised by a flat plate of about the same length as the longitudinal dimension of the floating main body 51, and its upper edge section is situated at about the level of the bottom surface of the floating main body 51. A plurality of stay plates and flow sections 55 are provided between the floating main body 51 and the plate-shaped member 54 so as to flood the water through.

When the floating main body 51 having a plate-shaped member 54 constructed in such a manner and floating on water is impacted by incoming waves 16 from the wavefront side (left side in FIG. 15), the side surface of the floating main body 51 is impacted by the incoming waves 16 and some of the waves flood through the flow sections 55. Therefore, the floating main body 51 not only reduces the wave energy by flooding the incoming waves 16 through the flow sections 55 but also the plate-shaped member 54 and the flow section 55 generate resistance to suppress rolling, and motion of the floating main body 51 is reduced.

In this case, reduction effect varies depending on the angle of the plate-shaped member 54 with respect to the bottom surface of the floating main body 51. FIG. 16 shows a graph of comparison of rolling amplitude when the angle of the plate-shaped member 54 is varied with respect to the bottom surface of the floating main body 51. As can be seen from the graph, when the plate-shaped member 54 is disposed at a downward angle (0–90 degrees), the rolling amplitude of the floating main body 51 is reduced and the period of rolling is shifted to a longer period, and motion of the floating main body 51 is reduced reliably.

In this case, when the angle of the plate-shaped member 54 to the bottom surface of the floating main body 51 is 0 degrees ($\alpha=0°$), the plate-shaped member 54 is in the same position as the horizontal plate 24 in the second embodiment, and when the angle of the plate-shaped member 54 to the floating main body 51 is 90 degrees ($\alpha=90°$), the plate-shaped member 54 is in the same position as the plumb plate 14 in the first embodiment. In other words, the angle of the plate-shaped member 54 can be adjusted to any angle within a range of −90° to +90° (counter clockwise is positive in FIG. 15) with respect to a plane extended from the bottom surface of the floating main body 51.

It should be noted that, in the embodiment described above, the plate-shaped member 54 is provided on the side surface of the floating main body 51, but the plate-shaped member 54 may be provided on both left and right side sections of the floating main body 51. Depending on the orientation of the floating main body 51, waves may impact from either left or right side of the floating main body 51, but in such a case, by providing a plate-shaped member 54 on both sides of the floating main body 51, rolling of the floating main body 51 against incoming waves can be suppressed and motion of the floating main body 51 can be reduced.

Also, in the embodiment described above, the plate-shaped member 54 is affixed with intervening stay plates as in the first embodiment. But as in the first embodiment, a plurality of guide rails may be affixed to one side section of the floating main body, and the guide member may be freely elevatably supported on the guide rails, and the plate-shaped member 54 may be supported with intervening stay plates to the guide member so that the guide member can be moved vertically by driving means (not shown but can be a chain drive, screw drive, fluid cylinder drive and the like).

Figure 17:
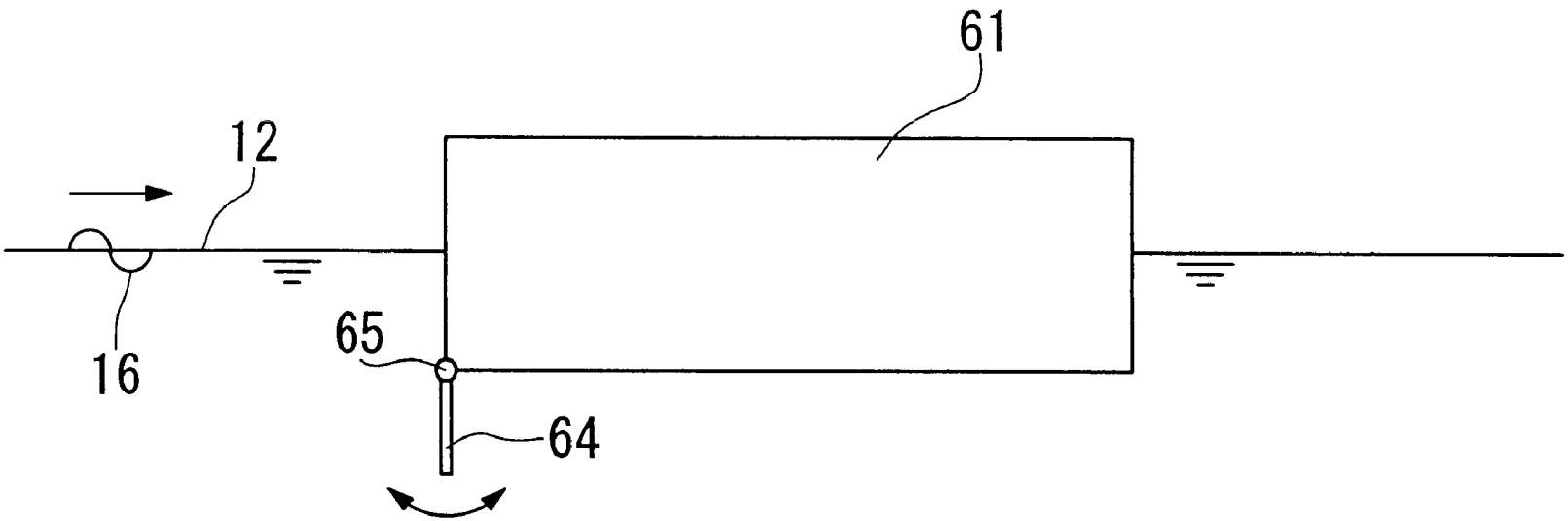
FIG. 17 is a schematic diagram of a sixth embodiment of the motion reduction apparatus for a floating body.

A sixth embodiment of the motion reduction apparatus will be explained along with FIGS. 17 and 18. As shown in FIG. 17, the motion reduction apparatus in this embodiment has a floating main body 61 of a similar structure to the floating main body 11 provided with a plate-shaped member 64 extending vertically from the bottom section of one lateral side section in the longitudinal direction, i.e., from the bottom section of the side section of the floating main body 61 by means of a hinge mechanism, and separated from the floating main body 61 at a given distance. The plate-shaped member 64 is comprised by a flat plate of about the same length as the longitudinal dimension of the floating main body 61. A plurality of flow sections 65 are provided between the floating main body 61 and the plate-shaped member 64 so as to flood the water therethrough.

When the floating main body 61 having a plate-shaped member 64 constructed in such a manner and floating on water is impacted by incoming waves 16 from the wavefront side (left side in FIG. 17), the side surface of the floating main body 61 is impacted and some of the waves flood through the flow sections 65. Therefore, the floating main body 61 not only reduces the wave energy by flooding the incoming waves 16 through the flow sections 65 but also the plate-shaped member 64 and the flow sections 65 generate resistance to suppress rolling, and motion of the floating main body 61 is reduced.

Figure 18:
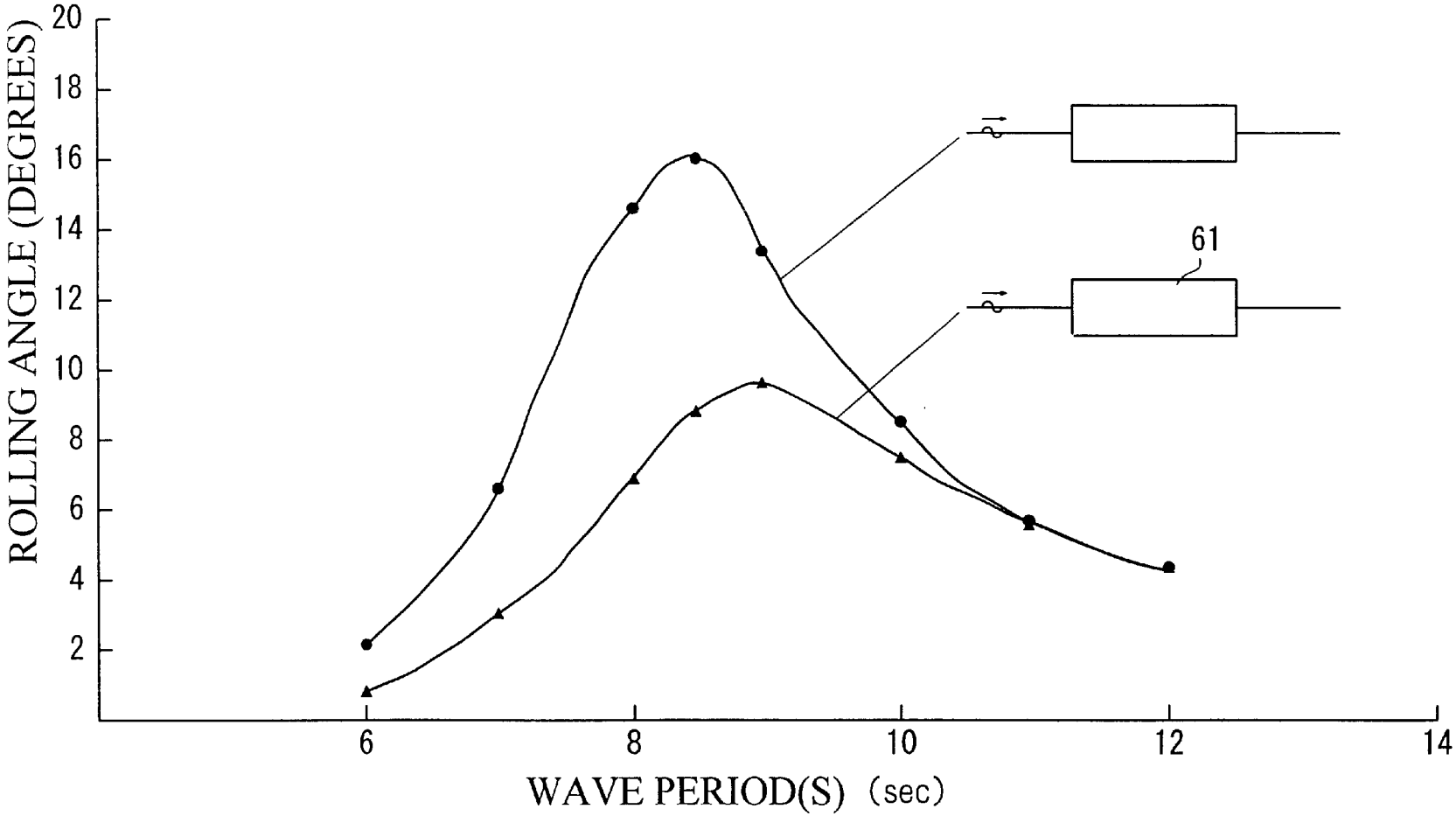
FIG. 18 is a graph of rolling amplitude of the floating main body and the wave period in the motion reduction apparatus for a floating body shown in FIG. 17.

FIG. 18 shows a graph of comparison of rolling amplitude and the wave period for the floating main body by itself and floating main body 61 with the plate-shaped member 54. As can be seen from the graph, when the plate-shaped member 64 is provided, the rolling amplitude of the floating main body 61 is reduced and the period of rolling is shifted to a longer period, and motion of the floating main body 61 is reduced reliably.

It should be noted that, in the embodiment described above, the plate-shaped member 64 is provided on the side section of the floating main body 61, but the plate-shaped member 64 may be provided on both left and right side sections of the floating main body 61. Depending on the orientation of the floating main body 61, waves may impact from either left or right side of the floating main body 61, but in such a case, by providing a plate-shaped member 64 on both side sections of the floating main body 61, rolling of the floating main body 61 against incoming waves can be suppressed and motion of the floating main body 61 can be reduced.

Figure 19:
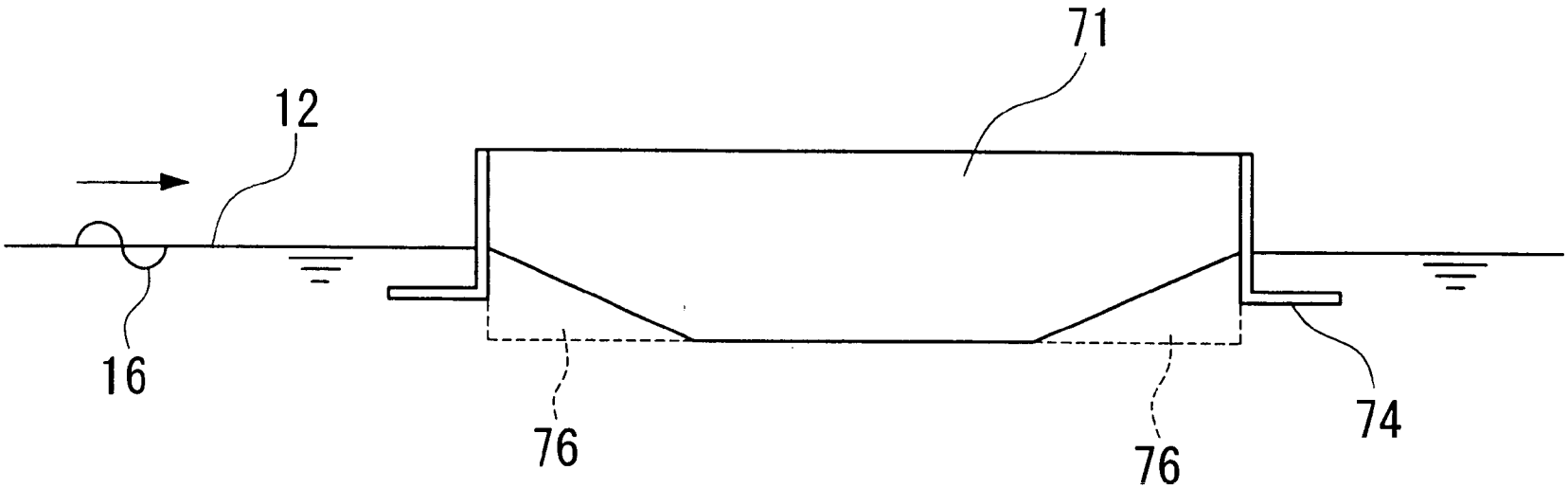
FIG. 19 is a schematic diagram of a seventh embodiment of the motion reduction apparatus for a floating body.

A seventh embodiment of the floating main body will be explained along with FIGS. 19 and 20. In the motion reduction apparatus in this embodiment, as shown in FIG. 19, the floating main body differs from the floating main bodies described in preceding embodiments in the following aspects. The edge sections 76 on both ends of the floating main body 71 in the longitudinal direction are removed so that the cross sectional area of the floating main body 71 in the longitudinal direction appears as a trapezoidal shape. Also, a L-shaped plate-shaped member 74 is affixed outwardly to the front and back sections of the floating main body 71 that extends in the longitudinal direction. The bottom section of the plate-shaped member 74 is situated below the water surface and at about the same level as the bottom surface of the floating main body 71.

When the floating main body 71 having a plate-shaped member 74 constructed in such a manner on the front section and floating on water is impacted by the incoming waves 16 from the wavefront side (left side in FIG. 17), the plate-shaped member 74 offers resistance to suppress pitching of the floating main body 71, and reduces motion of the floating main body 71.

Figure 20:
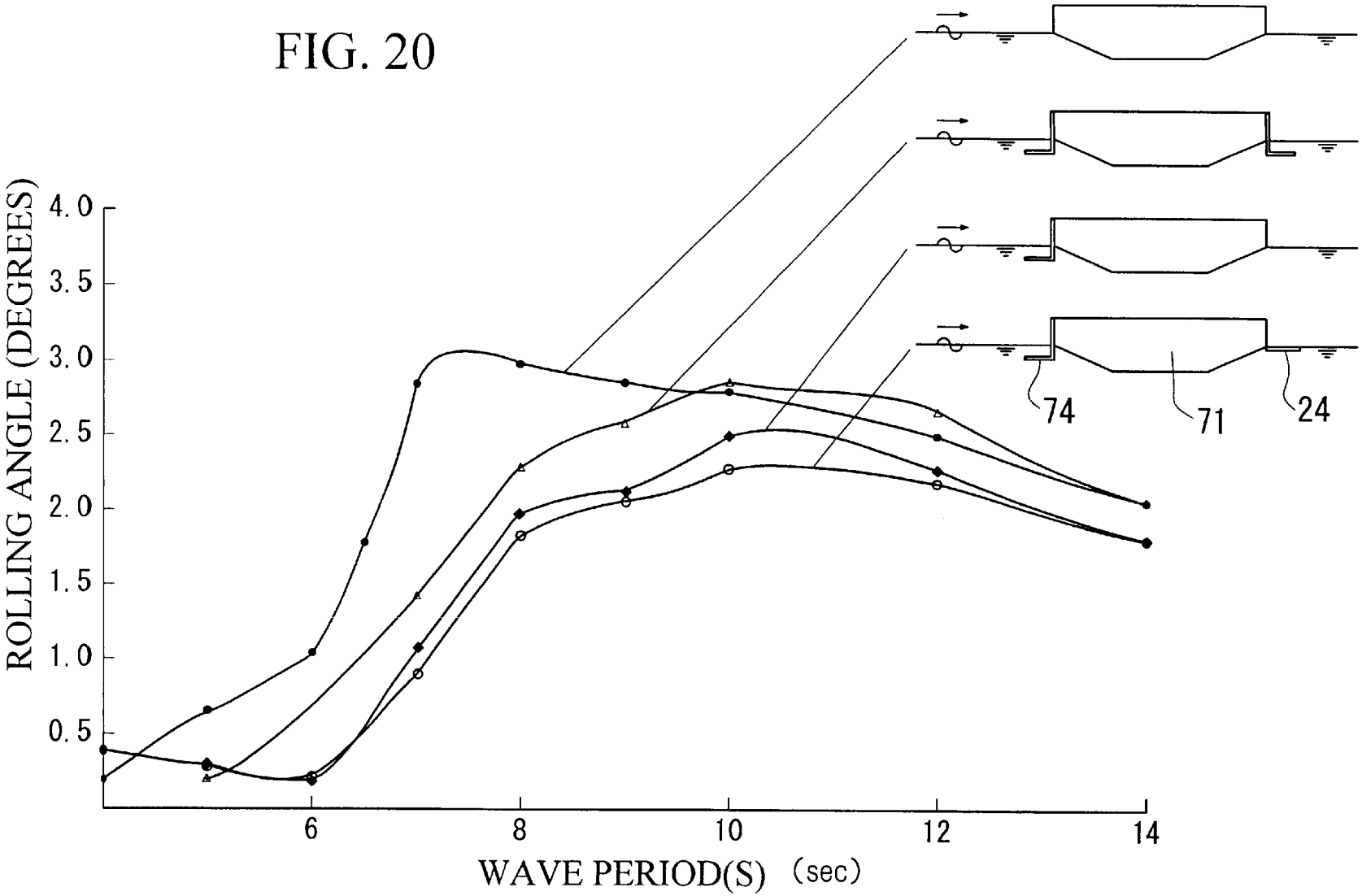
FIG. 20 is a graph of pitching amplitude and the wave period in the motion reduction apparatus for a floating body shown in FIG. 19.

FIG. 20 shows a graph of comparison of the wave period and the rolling amplitude of the floating main body 71 for the cases of: (1) floating main body by itself; (2) affixing a plate-shaped member 74 on the front and back section of the floating main body 71; (3) affixing a plate-shaped member 74 on either the front section or the back section of the floating main body 71; and (4) affixing a plate-shaped member 74 on the front section of the floating main body 71, and a water surface plate 44 described in the fourth embodiment on the back section. As shown in FIG. 20, the floating main body 71 having the plate-shaped member 74 and the like produces smaller pitching amplitudes compared with floating main body by itself, and motion of the floating main body 71 is reduced reliably.

It should be noted that, in the embodiment described above, the bottom section of the L-shaped plate-shaped member 74 is placed at about the same level as the bottom surface of the floating main body 71, but it is not limited such an arrangement. That is, so long as the bottom section of the L-shaped plate-shaped member 74 is fixed so as to be below the water surface, pitching amplitude of the floating main body 71 is reduced and motion of the floating main body 71 is reduced reliably.

Figure 21:
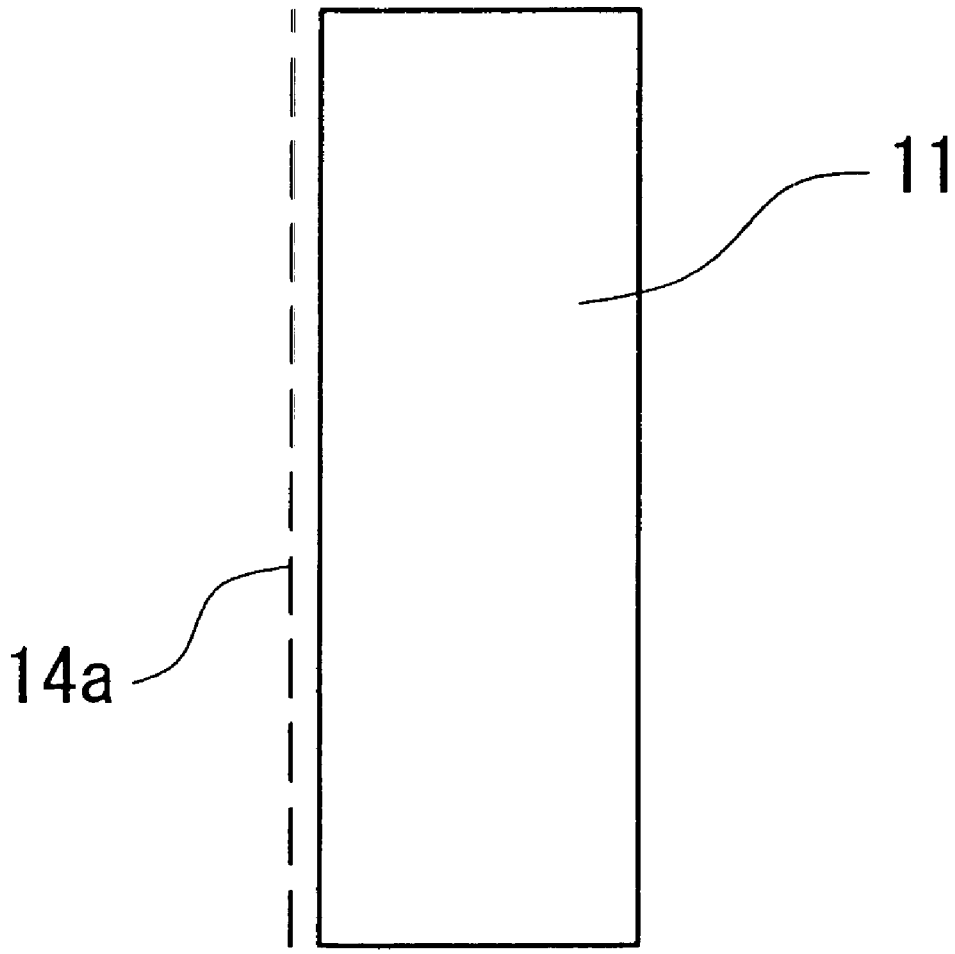
FIG. 21 is a plan view of a variation of the motion reduction apparatus for a floating body of the first embodiment.

A third variation of the first embodiment of the motion reduction apparatus will be explained along with FIGS. 21 and 22. Here, it should be noted that because FIG. 21 is a plan view in contract to FIG. 1, waterline is not shown in the diagram. In FIG. 21, the plumb plate 14*a* is divided by transverse gaps formed at about right angles to the longitudinal direction of the plumb plate 14*a*.

Figure 22:
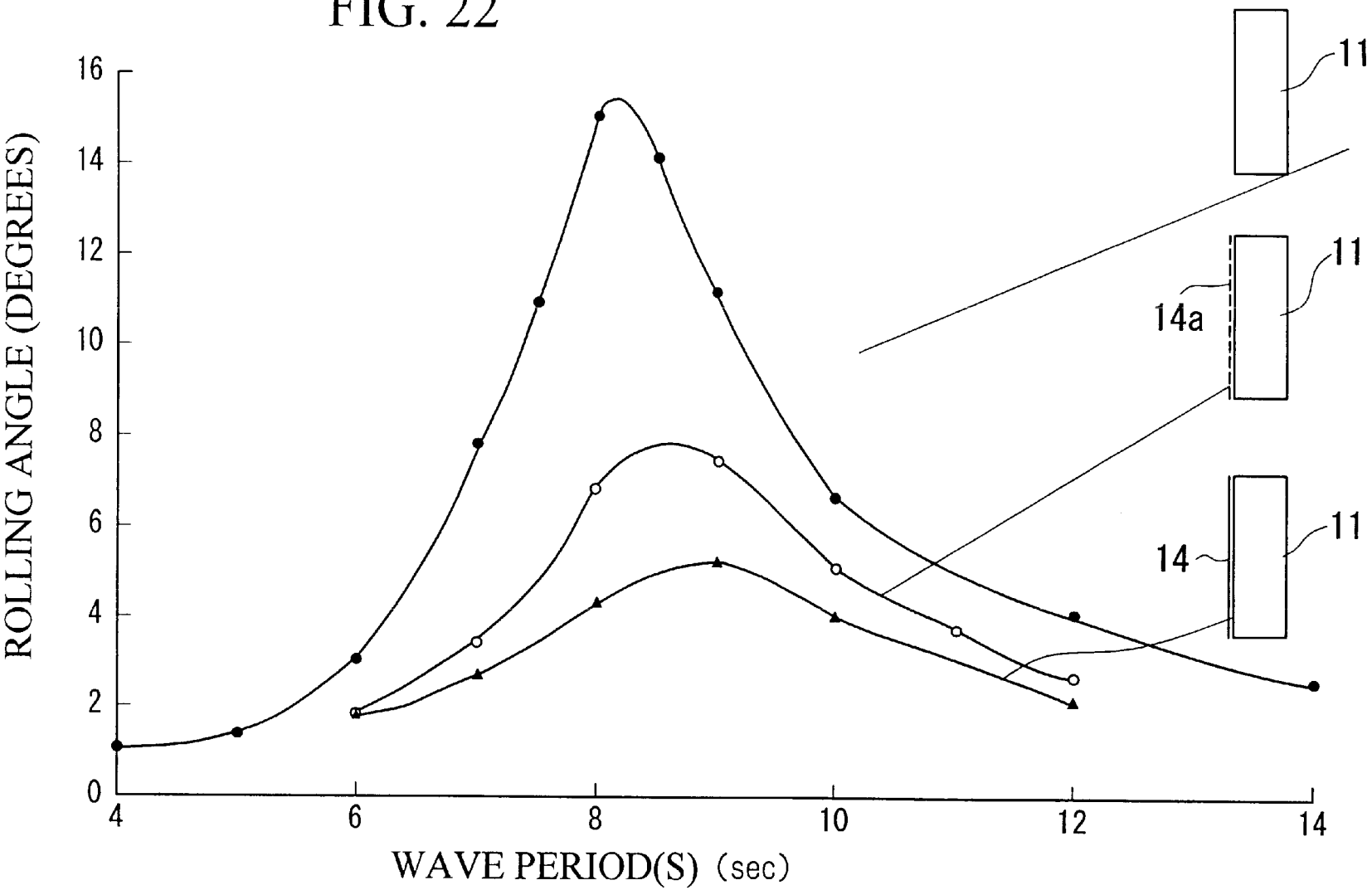
FIG. 22 is a graph of rolling amplitude and the wave period in the motion reduction apparatus shown for a floating body shown in FIG. 21.

FIG. 22 shows a graph of comparison of wave period and rolling amplitude of the floating main body for the cases of: (1) the floating main body by itself; (2) affixing a solid plumb plate 14; and (3) affixing a sub-divided plumb plate 14. As shown in FIG. 22, although the reduction effect is not as much as that provided by the solid plumb plate 14, the plumb plate 14*a* subdivided by the transverse gaps intersecting the plate at about right angles to the longitudinal direction of the plumb plate 14*a* can reduce the rolling amplitude of the floating main body 11 and the characteristic period is shifted to a longer period, and motion of the floating main body 11 is reduced reliably.

Similarly, when the horizontal plate shown in the second embodiment is subdivided by the gaps intersecting the plate at about right angles to the longitudinal direction of the horizontal plate, or when the plate-shaped member shown in the fifth embodiment is subdivided by the gaps intersecting the plate at about right angles to the longitudinal direction of the plate member, rolling amplitude of the floating main body 11 is reduced and the characteristic period is shifted to a lower period, thereby reliably reducing motion of the floating main body 11.

Figure 23:
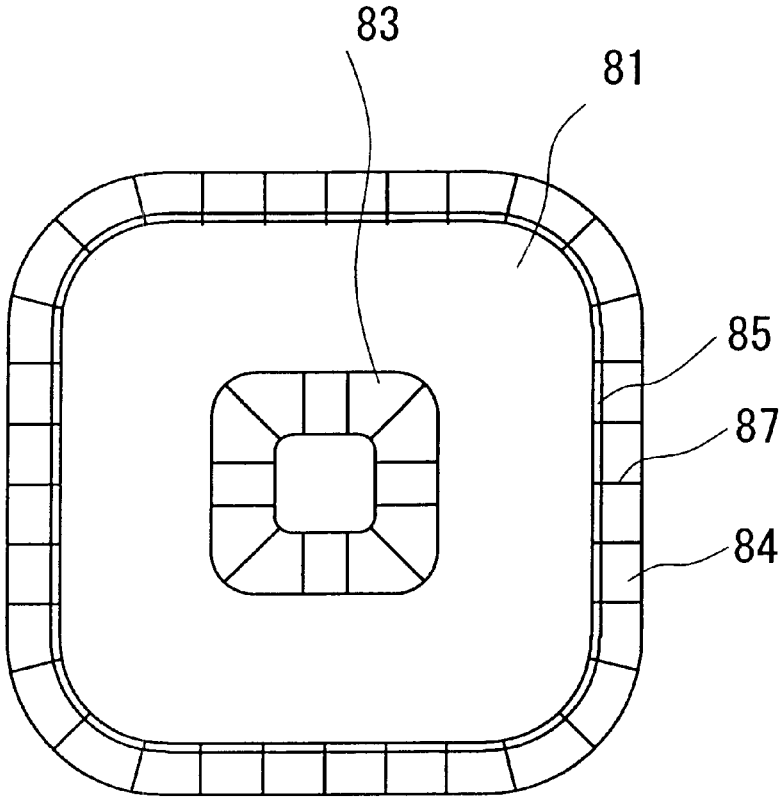
FIG. 23 is a front view of a variation of the motion reduction apparatus for a floating body in an eighth embodiment of the present invention.
Figure 24:
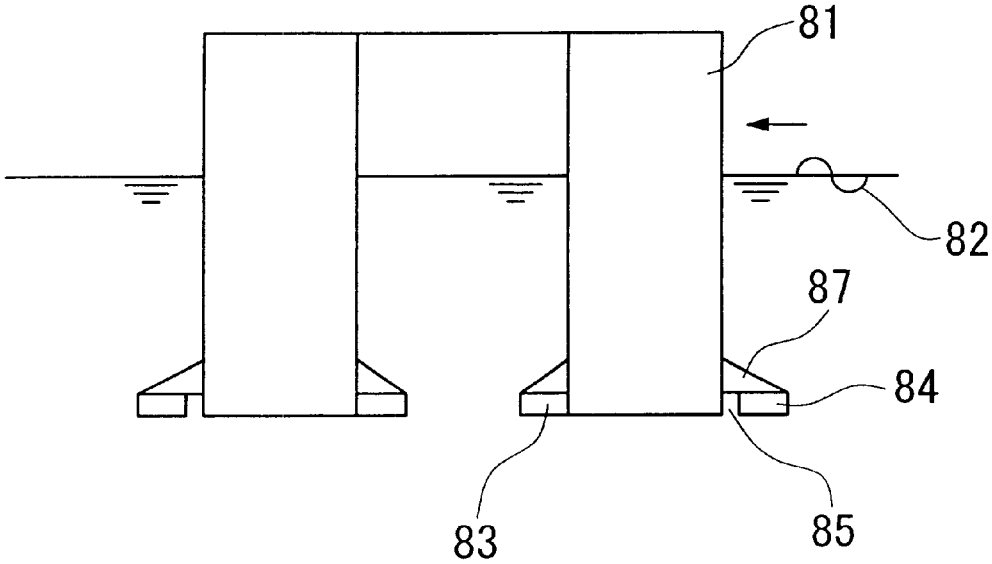
FIG. 24 is a side view of a motion reduction apparatus for a floating body in the eighth embodiment.
Figure 25:
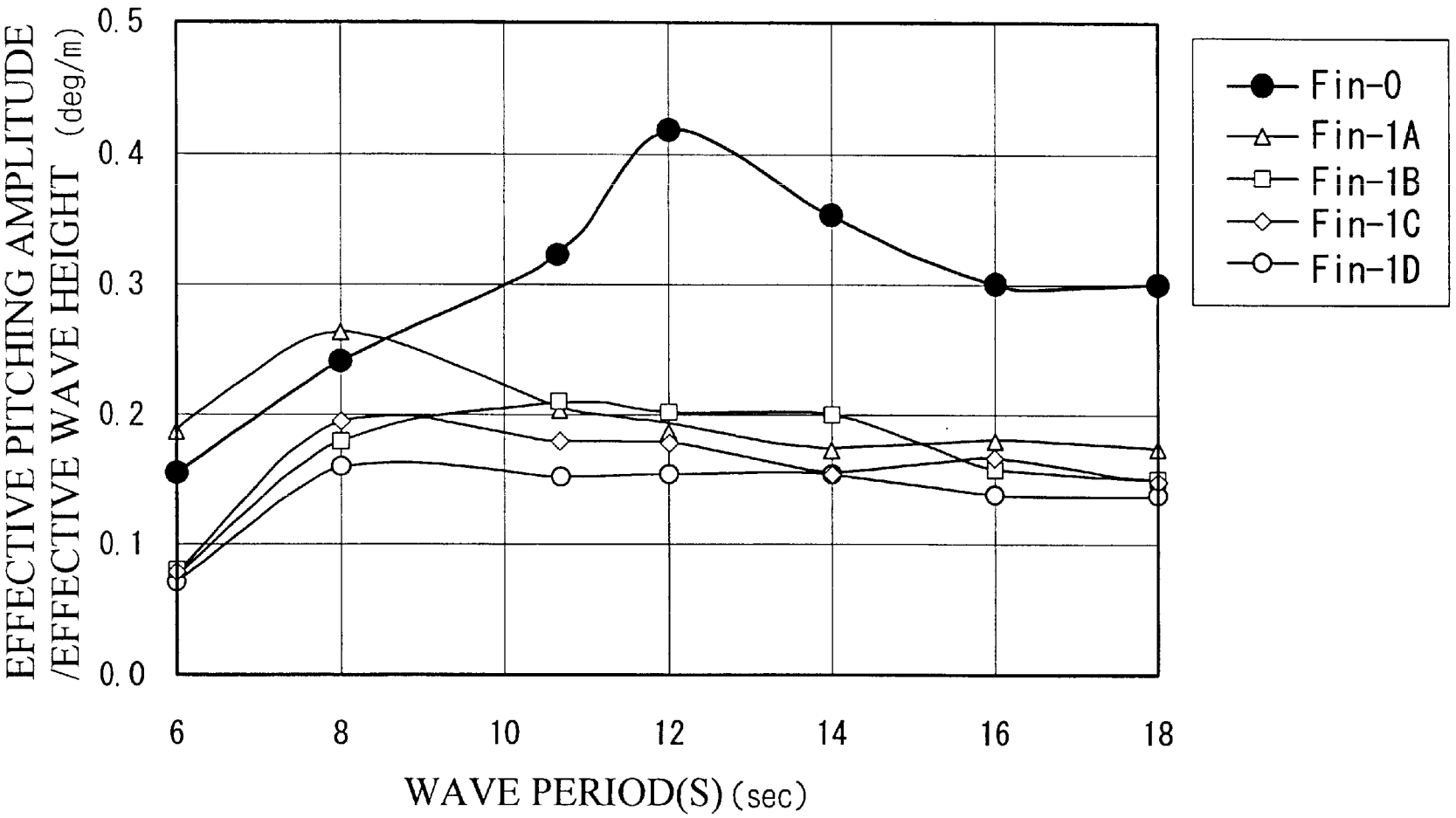
FIG. 25 is a graph of pitching amplitude and the wave period in the motion reduction apparatus for a floating body shown in FIGS. 23 and 24.

FIG. 23 shows a front view of the motion reduction apparatus in the eighth embodiment, FIG. 24 is a side view of the motion reduction apparatus in the eighth embodiment, and FIG. 25 is a graph of wave period and pitching amplitude of the floating main body obtained under the conditions shown in FIG. 26.

In the motion reduction apparatus of this embodiment, the floating main body 81 is a cylindrical member made of steel plates, for example, and has a hollow space through the center of the cylinder as shown in FIG. 24. The interior of the floating main body 81 is divided into a plurality of sealed floating chambers (omitted from the diagram). The floating main body 81 is thus able to float above the waterline 82 by the lift forces generated by the floating chambers.

Figure 29B:
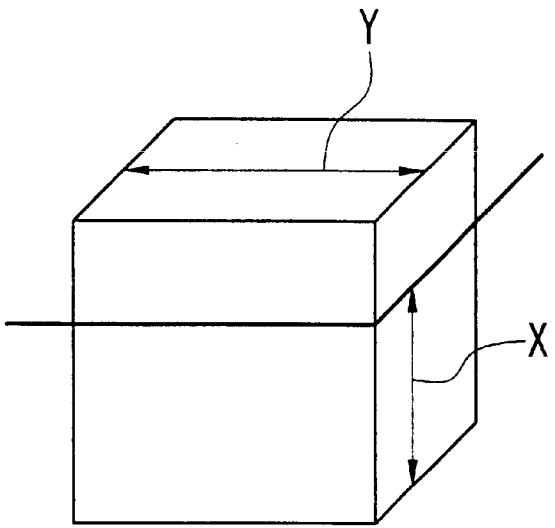
FIG. 29B is an upper perspective view of a floating body having a deep waterline.
Figure 29A:
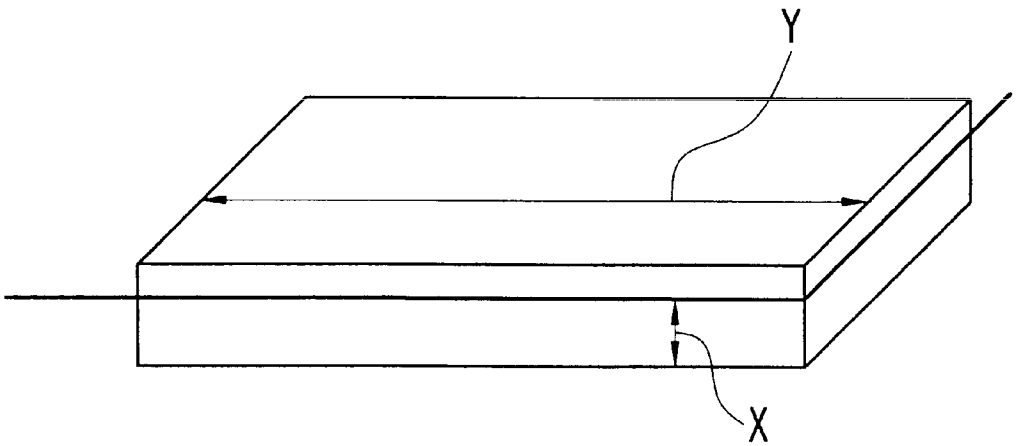
FIG. 29A is an upper perspective view of a floating body having a shallow waterline.

The floating body in Embodiment 8 has a waterline at a deeper level than the waterline of the floating bodies in Embodiments 1–7. The floating bodies in the preceding Embodiments 1–7 are, as shown in FIG. 29A, are constructed in such a way that the waterline depth X is smaller compared with the horizontal maximum dimension (longitudinal length) Y to result in a shallow waterline. On the other hand, the floating body in this embodiment is, as shown in FIG. 29B, constructed in such a way that the waterline depth X is about the same dimension as the horizontal dimension Y of the floating body to result in a deep waterline.

In such a floating body whose waterline width is about the same as the horizontal maximum length of the floating body, characteristic periods of rolling and pitching motions are sufficiently longer than the prominent period of incoming waves so that even if the incoming waves hit the body, motion caused by the prominent period component of the incoming waves hardly occurs, but it is vulnerable to motion caused by characteristic period of the floating main body induced by the incoming waves.

Here, prominent period refers to a range of cresting periods most frequently observed in real conditions on the sea surface, and if the characteristic period of motion is shifted to a longer period compared with the cresting period, motion due to such a cresting component is less likely to be generated.

As shown in FIGS. 23 and 24, the outer periphery of the floating main body 81 supports a motion reduction plate 84 with intervening stay plates at about the same height as the bottom surface of the floating main body 81. The motion reduction plate 84 is made of a flat plate similar to that used in the second embodiment, and, as shown in FIG. 23, it is formed around the entire outer periphery of the floating main body 81. And, between the floating main body 81 and the motion reduction plate 84, a plurality of flow sections 85 are formed in sub-divisions by a plurality of stay plates 87 so as to flood the water through the flow sections 85.

It should be noted that, although a horizontal flat plate is provided to serve as the motion reduction plate 84, but the plumb plate described in the first embodiment or the plate shaped member described in the fifth embodiment may also be used. In other words, the motion reduction plate 84 refers to a plate that can not only reduce rolling amplitude of the floating main body 81 but can also shift the characteristic rolling period to a longer period, thereby reducing the wave energy of the incoming waves to reduce motion of the floating main body 81. Thus, at least all those plates described in Embodiments 1–7 are included in the motion reduction plate 84.

Also, a motion reduction plate 83 is provided on the bottom surface of the floating main body 81 on the internal hollow side of the floating main body 81. The motion reduction plate 83 is made of a flat plate, and as shown in FIG. 23, it is formed along the entire inner periphery of the floating main body 81.

When the floating main body 81 having motion reduction plates 83 and 84 constructed in such a manner and floating on water is impacted by incoming waves 86 from the wavefront side (right side in FIG. 24), the side surface and the motion reduction plate 84 of a floating main body 81 are impacted by the incoming waves 86 and some of the waves flood through the flow sections 85. Therefore, the floating main body 81 is able to suppress rolling and pitching having characteristic periods because of the resistance offered by the motion reduction plate 84 and the flow sections 85.

FIG. 26 shows a table of pitching amplitudes for the wave period of the floating main body 81 having various motion reduction plates 84 (Fin1A~Fin1D). These motion reduction plates 84 (Fin1A~Fin1D) are provided with various fins having a fin width (including spacing) of 8 mm size for a floating body having a total length of 96 m, in such a way that: Fin1A has no spacing (flow section) and a motion reduction plate 84 of 8 m length is provided directly on the floating main body 81; Fin1B has a 0.5 m spacing (flow section 85) between the floating main body 81 and a motion reduction plate 84 of 7.5 m in length; Fin1C has a 1.0 m spacing (flow section 85) between the floating main body 81 and a motion reduction plate 84 of 7.0 m in length; and Fin1D has a 1.9 m spacing (flow section 85) between the floating main body 81 and a motion reduction plate 84 of 6.1 m in length.

From the results shown in the table in FIG. 25, by comparing the cases of providing various motion reduction plates 84 (Fin1A~Fin1D) and the case of providing no motion reduction plate 84 (Fin0), it can be seen clearly that the pitching amplitude of the floating main body 81 is reduced, thereby reducing motion of the floating main body 81.

Further, the use of the motion reduction plate 83 provided on the internal periphery of the floating main body 81 reduces heaving, rolling and pitching having characteristic periods, thereby reducing motion of the floating main body 81.

It should be noted that, although the motion reduction plates 83, 84 are provided along the entire inner and outer peripheries of the floating main body 81, but the present invention is not limited to such arrangements, and the motion reduction plates 83, 84 may be provided with gaps in between, to produce the same actions and effects.

Figure 27A:
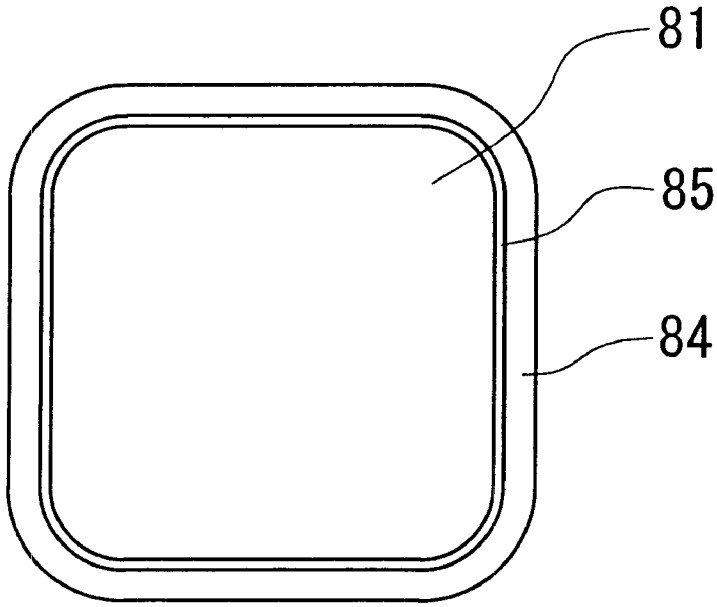
FIG. 27A is a plan view of a motion reduction apparatus for a floating body in the variation of the eighth embodiment.
Figure 27B:
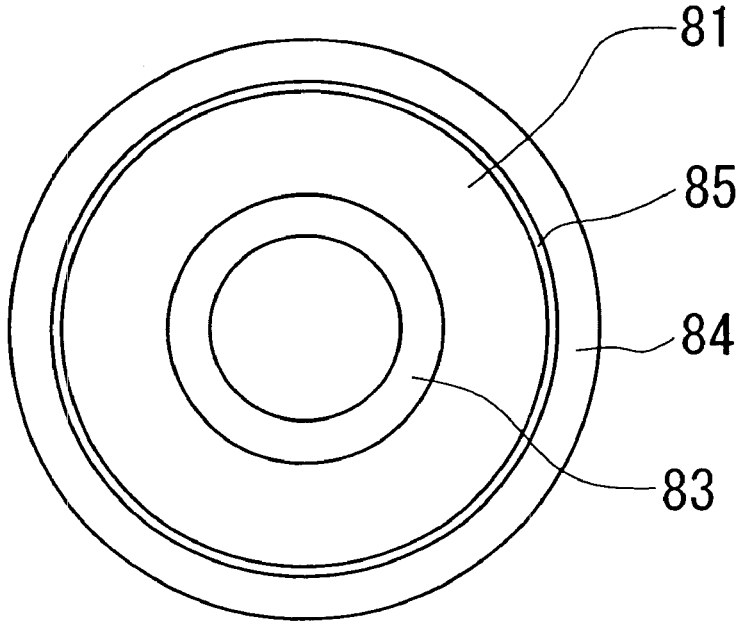
FIG. 27B is a plan view of a motion reduction apparatus for a floating body in the variation of the eighth embodiment.
Figure 28A:
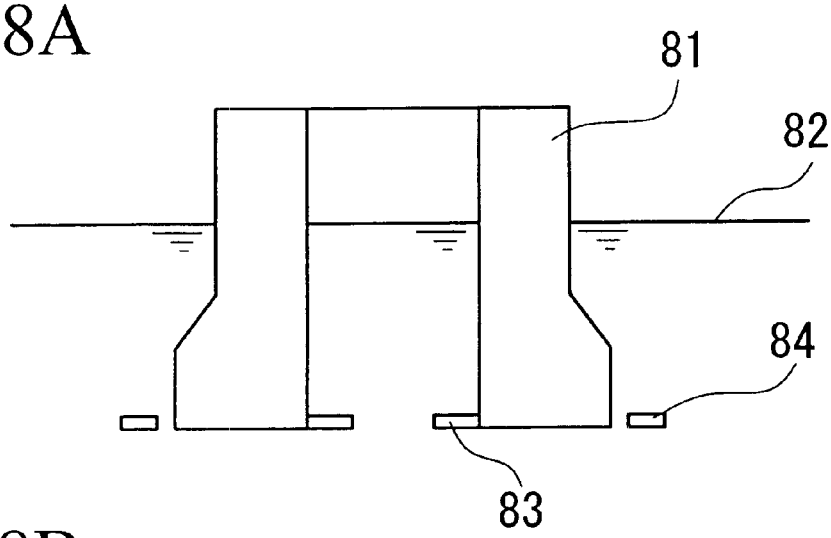
FIG. 28A is a side view of a motion reduction apparatus for a floating body in the variation of the eighth embodiment.
Figure 28B:
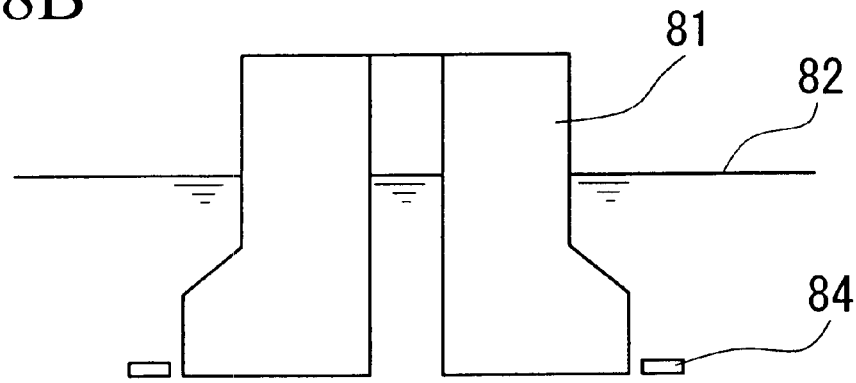
FIG. 28B is a side view of a motion reduction apparatus for a floating body in the variation of the eighth embodiment.
Figure 28C:
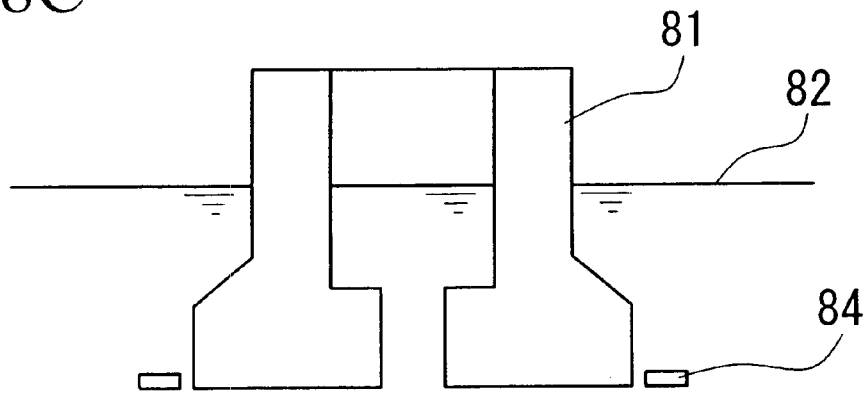
FIG. 28C is a side view of a motion reduction apparatus for a floating body in the variation of the eighth embodiment.

Also, same actions and effects of the motion reduction plates 83, 84 are obtained for a floating main body 81 that has solid interior as shown in FIG. 27A, or for a floating main body 81 of a cylindrical shape as shown in FIG. 27B. Further, although the cross sectional shape of the floating main body is uniform as shown in FIG. 24 in this embodiment, but the motion reduction plates 83, 84 can produce same actions and effects on a floating main body having non-uniform cross sectional shape, as shown in FIGS. 28A–28C. In other words, the present invention can be adapted to various shapes of floating main bodies.

Also, in each of the embodiment described above, a plumb plate 14, horizontal plate 24 or swing plate 34 is provided, respectively, on side sections of a floating main body 11, 21 or 31 to suppress rolling motion, and a plumb plate 14, horizontal plate 24 or swing plate 34 is provided on front and back sections, respectively, of a floating main body 41 to suppress pitching motion, but rolling and pitching motion can be suppressed by providing the horizontal plates and the like on the side sections as well as on the front and back sections.

Also, in each of the embodiment described above, a floating main body 11, 21, 31 or 41 is made into an orthorhombic shape, but other shapes such as tetragonal or cylindrical shapes may be adopted for a floating body for affixing plumb plates or horizontal plates.

What is claimed is:

1. A motion reducing apparatus for a floating body floating on water comprising a horizontal plate provided at least on a wavefront side of the floating main body and separated from the floating main body through a space having a specified distance and extended substantially along a horizontal direction, wherein an upper surface of the horizontal plate is situated at a same height as a portion of a bottom surface of the floating main body that is disposed a maximum distance below a top surface of the floating main body opposite to the bottom surface.

2. A motion reducing apparatus according to claim 1, wherein the horizontal plate is supported at a specific location of the floating main body by means of a plurality of stay members arranged on the floating main body in parallel so as to provide said space by means of flow sections provided between the adjacent stay members for flooding with incoming water.

3. A motion reduction apparatus according to claim 1, wherein the floating main body is orthorhombic-shaped, and the horizontal plate is provided at least on one left or right side section along the longitudinal direction of the floating main body.

4. A motion reducing apparatus according to claim 1, wherein the horizontal plate is constructed so as to be relocatable above the bottom surface of the floating main body and to remain horizontal after being relocated.

5. A motion reduction apparatus according to claim 1, wherein the horizontal plate is subdivided by gaps formed substantially at right angles to a direction extending from the horizontal plate.

* * * * *